US011484754B2

(12) United States Patent
Paganelli et al.

(10) Patent No.: US 11,484,754 B2
(45) Date of Patent: Nov. 1, 2022

(54) METHOD FOR DETERMINING RUNNING PHASES OF A USER ON A TREADMILL AND TREADMILL IMPLEMENTING SUCH METHOD

(71) Applicant: TECHNOGYM S.p.A., Forli'-Cesena (IT)

(72) Inventors: Paolo Paganelli, Forli'-Cesena (IT); Claudio Serra, Forli'-Cesena (IT); Giuseppe Fedele, Forli'-Cesena (IT); Fabio Ronchi, Bologna (IT); Alessandro Del Monaco, Forli'-Cesena (IT)

(73) Assignee: TECHNOGYM S.p.A., Forli'-Cesena (IT)

( * ) Notice: Subject to any disclaimer, the term of this patent is extended or adjusted under 35 U.S.C. 154(b) by 343 days.

(21) Appl. No.: 16/637,523

(22) PCT Filed: Aug. 8, 2018

(86) PCT No.: PCT/IB2018/055964
§ 371 (c)(1),
(2) Date: Feb. 7, 2020

(87) PCT Pub. No.: WO2019/030687
PCT Pub. Date: Feb. 14, 2019

(65) Prior Publication Data

US 2020/0215391 A1 Jul. 9, 2020

(30) Foreign Application Priority Data

Aug. 8, 2017 (IT) ..... 102017000091682

(51) Int. Cl.
*A63B 24/00* (2006.01)
*A63B 22/02* (2006.01)

(52) U.S. Cl.
CPC ..... *A63B 24/0062* (2013.01); *A63B 22/025* (2015.10); *A63B 24/0087* (2013.01);
(Continued)

(58) Field of Classification Search
CPC ..... A63B 24/0062; A63B 22/025; A63B 24/0087; A63B 2220/30; A63B 2220/62;
(Continued)

(56) References Cited

U.S. PATENT DOCUMENTS 8,460,001 B1 * 6/2013 Chuang ..... A63B 24/0062 434/247
8,480,541 B1 * 7/2013 Brunts ..... A63B 22/025 482/7

(Continued)

FOREIGN PATENT DOCUMENTS

CN 205055307 U 3/2016
EP 3202467 A2 * 8/2017 ..... A63B 22/02

(Continued)

OTHER PUBLICATIONS

International Search Report and Written Opinion of the International Searching Authority for International Patent Application No. PCT/IB2018/055964 dated Dec. 5, 2018, 10 pages.

(Continued)

*Primary Examiner* — Sundhara M Ganesan
(74) *Attorney, Agent, or Firm* — Merchant & Gould P.C.

(57) ABSTRACT

A method determines running phases of a user on a treadmill having first and second rotating elements rotating about respective rotational axes transverse to a longitudinal axis of the treadmill. A physical exercise surface connects to the rotating elements. An electric motor operatively associated with one rotating element rotates the rotating elements and the physical exercise surface. A processor connects to the electric motor and controls the electric motor. The processor (Continued)

determines a magnitude variable over time, which is correlated to user interaction with the exercise surface while exercising and has a periodic trend. The processor determines time instants of at least two points of the periodic trend. The time instants of each point representing instants of user interaction with the exercise surface. The processor determines a running phase of the user on the exercise surface as a function of the respective time instants of the periodic trend.

19 Claims, 10 Drawing Sheets

(52) U.S. Cl.
CPC ..... *A63B 2220/30* (2013.01); *A63B 2220/62* (2013.01); *A63B 2220/833* (2013.01)

(58) Field of Classification Search
CPC ..... A63B 2220/833; A63B 2220/10; A63B 2220/34; A63B 2220/36; A63B 2220/805; A63B 22/0235
See application file for complete search history.

(56) References Cited

U.S. PATENT DOCUMENTS

| | | | | |
|---|---|---|---|---|
| 10,617,331 | B1 * | 4/2020 | Solberg | A63B 24/0087 |
| 2004/0242377 | A1 * | 12/2004 | Frykman | A63B 22/0235 482/54 |
| 2004/0259690 | A1 * | 12/2004 | Frykman | A63B 22/0235 482/8 |
| 2008/0234107 | A1 * | 9/2008 | Cox | A61B 5/1038 482/8 |
| 2009/0023556 | A1 * | 1/2009 | Daly | A63B 24/0062 482/9 |
| 2012/0191017 | A1 * | 7/2012 | Huang | A61F 2/72 600/595 |
| 2013/0035215 | A1 * | 2/2013 | Ashby | A63B 22/0242 482/54 |
| 2013/0131555 | A1 | 5/2013 | Hook et al. | |
| 2016/0144226 | A1 * | 5/2016 | Artemiadis | A63B 22/0228 482/54 |
| 2016/0166879 | A1 | 6/2016 | Dilli et al. | |
| 2016/0189437 | A1 * | 6/2016 | Pyles | A63B 24/0062 482/8 |
| 2016/0284231 | A1 * | 9/2016 | Walsh | G09B 19/0038 |
| 2020/0215391 | A1 * | 7/2020 | Paganelli | A63B 22/025 |
| 2021/0187347 | A1 * | 6/2021 | Remsberg | A61H 3/00 |

FOREIGN PATENT DOCUMENTS

| | | | | |
|---|---|---|---|---|
| FR | 2 886 862 | A1 | 12/2006 | |
| JP | 2011-050451 | A | 3/2011 | |
| WO | WO-2018075563 | A1 * | 4/2018 | A63B 21/00076 |

OTHER PUBLICATIONS

Nakashima, Y. et al., "Treadmill motor current based anteroposterior force estimation using ground reaction force approximation in depending on gait cycle", Engineering in Medicine and Biology Society, EMBC, 2011 Annual International Conference of the IEEE, 1583-1589 (Aug. 2011).

Ye, J. et al., "Development of a novel FES control system based on treadmill motor current variation for gait rehabilitation of hemiplegic patients after stroke", 2013 13th International Conference on Control, Automation and Systems (ICCAS 2013), 635-640 (Oct. 2013).

* cited by examiner

METHOD FOR DETERMINING RUNNING PHASES OF A USER ON A TREADMILL AND TREADMILL IMPLEMENTING SUCH METHOD

This application is a National Stage Application of PCT/IB2018/055964, filed 8 Aug. 2018, which claims benefit of patent application Ser. No. 102017000091682, filed 8 Aug. 2017 in Italy and which applications are incorporated herein by reference. To the extent appropriate, a claim of priority is made to each of the above-disclosed applications.

FIELD OF THE INVENTION

The present invention relates to the fitness sector, and in particular to a method for determining running phases of a user on a treadmill and to a treadmill implementing such method.

BACKGROUND OF THE INVENTION

Nowadays, determining of the running phases of a user is a very important aspect which allows to better monitor the pace quality of a user while running in order to prevent strain on the joints, pain, injuries and accidents and, in the case of competitive running, as well as to improve performance by reducing the waste of energy, fatigue and so on.

In this regard, a running phase of a user is the so-called phase of overstride.

Indeed, the phase of overstride occurs when the beginning of the contact of a foot on the running surface occurs in a point along the running direction, ahead of the point of the running surface in which the vertical line passing through the center of gravity of the user's body falls.

If the quality of the user's running pace is good, the beginning point of the contact of the user's foot on the running surface should substantially coincide with the point of the running surface in which the vertical line passing through the center of gravity of the user's body falls and the user's pace is thus considered optimal (limited to the phase of overstride) and no substantial changes are needed to eliminate such an effect.

One way, although not the best, to determine the phase of overstride is correlated to detecting the angular inclination of the tibia of the user's front leg with respect to the vertical traceable from the center of gravity of the body, considering a horizontal running plane.

Specifically, if the phase of overstride is acceptable because it is small, the angular inclination of the tibia of the front leg substantially coincides with the vertical traceable between the center of gravity of the user's body and the horizontal running plane. Once again, the quality of the user's pace is considered optimal, limitedly to a phase of overstride, such as not to require substantial corrections.

Once again, in presence of an unacceptable phase of overstride, the set angle of the angular inclination of the front leg with respect to the vertical traceable between the center of gravity of the body and the horizontal plane may be not null or may be in all cases greater than a set threshold value.

So, the quality of the user's pace is deemed not optimal (at least limitedly to the phase of overstride) and running corrections are consequently needed to eliminate or at least reduce as much as possible the phase of overstride, whereby preventing strain on joints, pain, injuries, accidents and possibly improve the athletic performance in the case of competitive running.

According to a solution of the prior art, a method for determining running phases of a user, among which is the phase of overstride, includes using an electronic device, e.g. an inertial measurement unit (IMU), which can be worn by the user, e.g. applied on the tibia of a leg, adapted to detect various inertial parameters representative of the motion of the leg, such as, for example, an angle of inclination with respect to the horizontal plane, rotational velocity, acceleration and so on.

The parameters detected by the inertial measurement unit are employed by a microprocessor (of the electronic device applied on the leg or a further electronic device worn by the user even on another part of the body, e.g. at the waist) to determine the contact of the foot on the running plane, and so the amplitude of the phase of overstride in order to indicate need to correct the pace or not to the user.

This method for determining the phase of overstride is not free from defects.

Firstly, this method requires the use of one or more electronic devices that the user must wear while running.

Such one or more electronic devices, in addition to causing annoyance to the user while running, are subject to movements or impacts which could imply, on one hand, the imperfect detection of measurable inertial parameters and, on the other hand, the displacement or even the accidental falling from the leg or part of the body onto which the electronic devices are applied.

Furthermore, multiple electronic devices with inertial measurement units, e.g. one for each leg or even one on each calf and on each thigh, hip, and so forth, could be provided in order to improve measurement accuracy or completeness.

However, it is apparent that increasing the number of electronic devices which can be worn by the user causes a considerable increase of the annoyance for the user who, on the contrary, wants to be as free as possible while running.

Furthermore, the detection of one or more inertial parameters representative of the leg, such as the inclination angle of the tibia, are in all cases indirect measurements from which to determine the phase of overstride which make the evaluation somewhat imprecise and not very significant despite successive processing.

SUMMARY OF THE INVENTION

It is the object of the present invention to devise and provide a method for determining running phases of a user on a treadmill which allows to solve, at least partially, the drawbacks mentioned above with reference to the prior art, which is the less invasive as possible for the user and which guarantees high accuracy and promptness of the obtainable results.

Such an object is achieved by a method for determining running phases of a user on a treadmill.

The treadmill comprises:

- a base extending along a longitudinal axis, said base comprising:
- a first rotating element and a second rotating element adapted to rotate around respective rotational axes transverse to the longitudinal axis of the base;
- a physical exercise surface operatively connected to the first rotating element and to the second rotating element;
- an electric motor operatively associated with at least one of said first rotating element and second rotating element, the electric motor being configured to make the first rotating element and the second rotating element rotate, also driving the physical exercise surface into rotation;

a data processing unit operatively connected to the electric motor, the data processing unit being configured to control said electric motor.

The method comprises steps of:

(a) determining, by the data processing unit, a magnitude variable over time correlated to the interaction of the user with the physical exercise surface while performing the physical activity, the magnitude variable over time having a substantially periodic trend;

(b) determining, by the data processing unit, respective time instants of at least two points among a plurality of points of the periodic trend of the magnitude variable over time, the respective time instants of each point of said plurality of points being representative of instants of the interaction of the user with the physical exercise surface of the treadmill while running;

(c) determining, by the data processing unit, at least one running phase of the user on the physical exercise surface of the treadmill as a function of the respective time instants of said at least two points determined from the plurality of points of the periodic trend of the magnitude variable over time.

It is an object of the present invention also a treadmill implementing such method.

BRIEF DESCRIPTION OF THE DRAWINGS

Further features and advantages of the method and treadmill according to the invention will become apparent from the following description which discloses preferred embodiments, given by way of indicative, non-limiting examples, with reference to the accompanying drawings, in which.

DETAILED DESCRIPTION OF THE PREFERRED EMBODIMENTS

Figure 1:
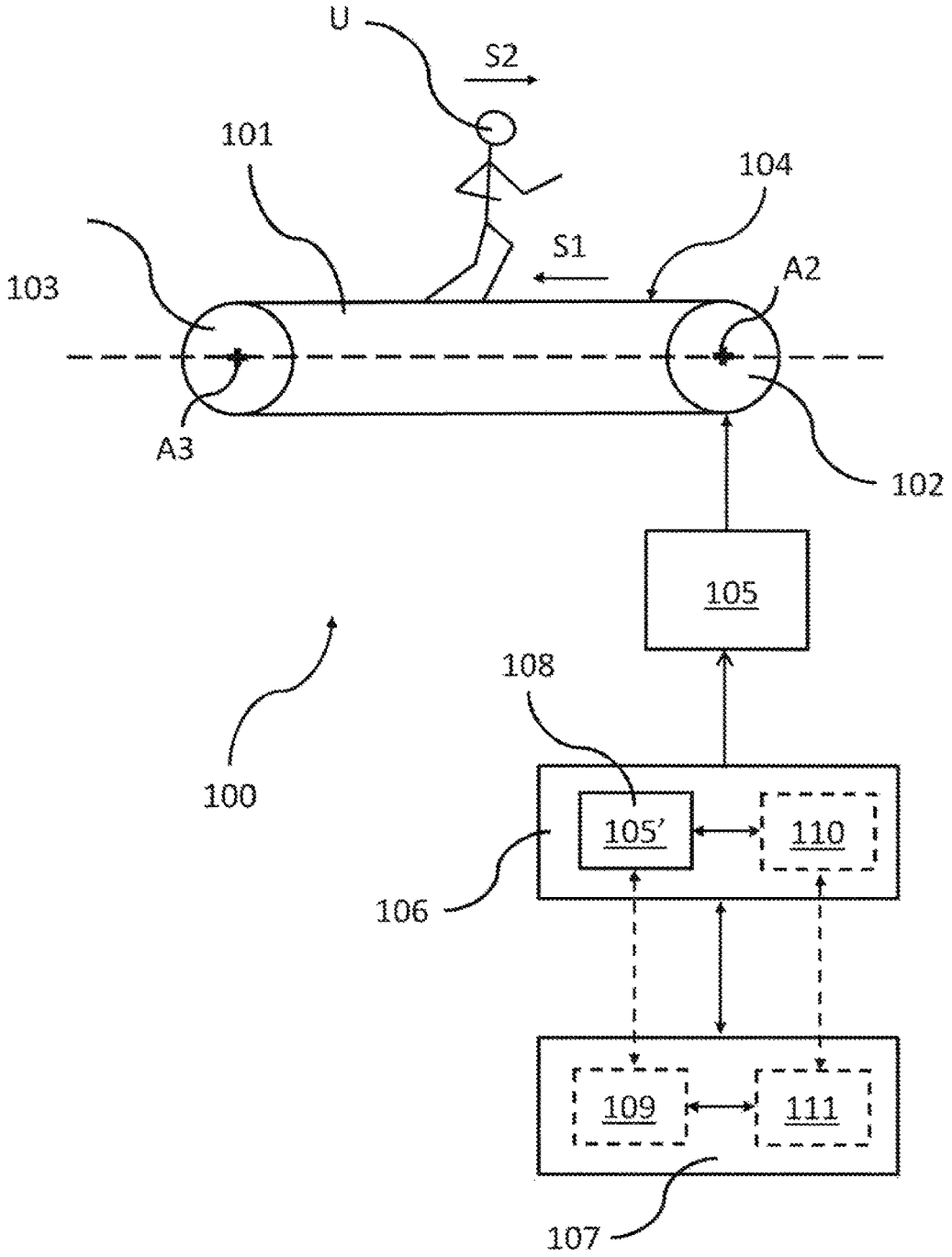
FIG. 1 shows, by means of a block chart, a treadmill according to an embodiment of the present invention.

It is worth noting that equivalent or similar elements are indicated by the same numerical and/or alphanumerical reference in the aforesaid drawings.

Reference numeral 100 indicates a treadmill as a whole.

Figure 2:
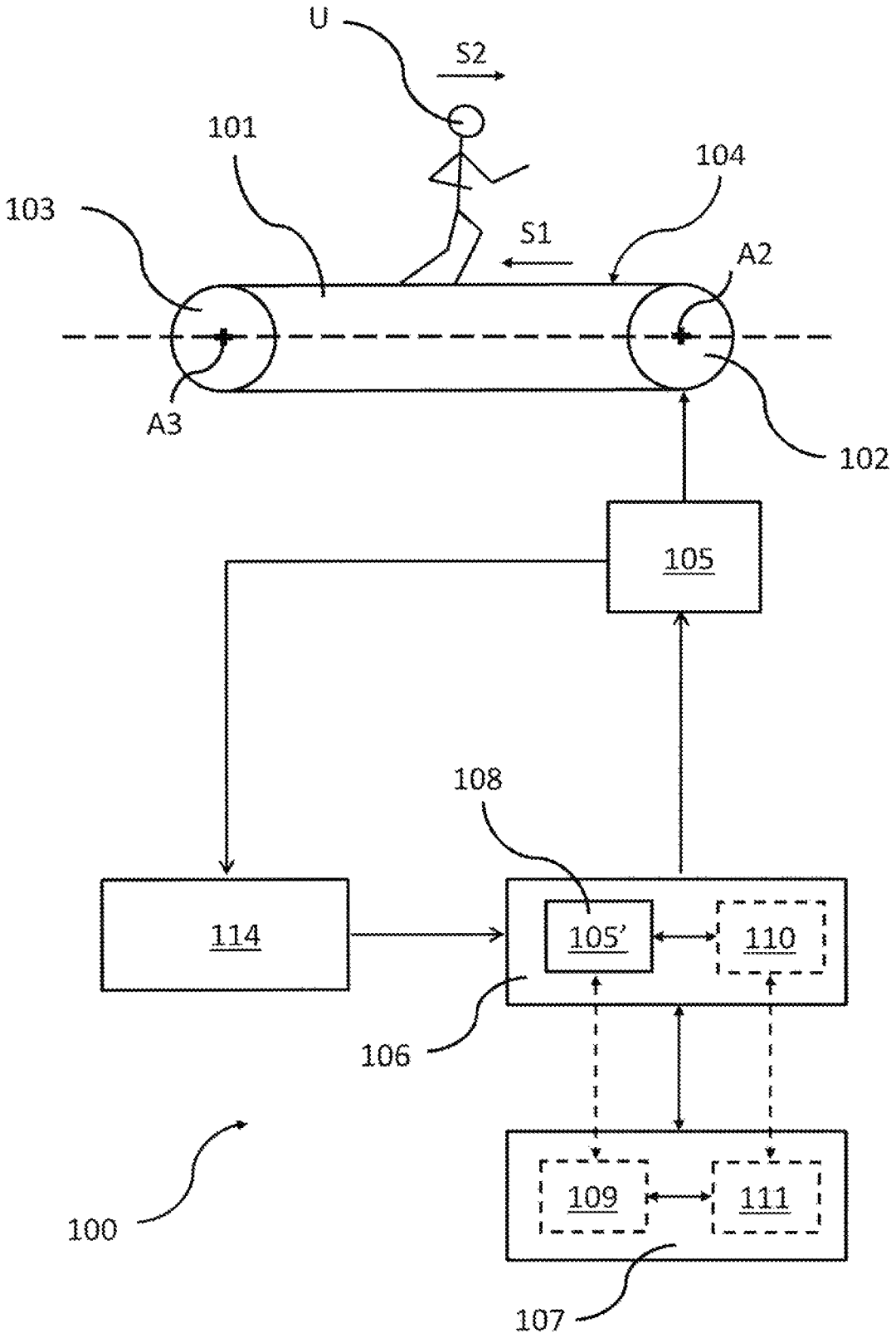
FIG. 2 shows, by means of a block chart, a treadmill according to a further embodiment of the present invention.

It is worth noting that FIGS. 1 and 2 show some embodiments of the treadmill 100 and of some components simply by means of a block chart in order to highlight the technical features which are essential and important for better understanding the present invention.

With particular reference to the embodiment shown in FIG. 1 and to the embodiment shown in FIG. 2, the treadmill 100 comprises a base 101 extending along a longitudinal axis L, indicated by a dashed line in the figure.

The base 101 comprises a first rotating element 102 and a second rotating element 103 adapted to rotate about respective rotational axes, a first rotational axis A2 for the first rotating element 102 and a second rotational axis A3 for the second rotating element 103, transversal to the longitudinal axis L of the base 101 of the treadmill 100.

It is worth noting that the first rotating element 102 is arranged at an end of the base 101, whilst the second rotating element 103 is arranged at a second end of the base 101, opposite to said first end along the longitudinal axis L of the base 101.

The base 101 further comprises a physical exercise surface 104 operatively connected to the first rotating element 102 and to the second rotating element 103.

It is worth noting that the physical exercise surface 104, between the first rotating element 102 and the second rotating element 103, has a side profile which is substantially parallel with respect to the longitudinal axis L of the base 101.

For the purposes of the present description, "physical exercise surface" means the rotational surface of the treadmill 100 on which a user U (diagrammatically shown in FIGS. 1 and 2), by placing his or her feet or lower limbs in general, can carry out a physical exercise, such as, for example, running, and also pushing exercises, or any other type of physical exercise that the treadmill 100 allows.

Running is the physical exercise to which reference will be made in particular for the purposes of the present invention.

Furthermore, it is worth noting that "rotating element" means any mechanical element adapted to rotate about a respective rotational axis so as to impart a rotation to the "physical exercise surface" operatively associated with one or more of these rotating elements.

The type of rotating elements, some examples of which will be described below, depends on the type of physical exercise surface to be rotated.

In greater detail, the rotation of the first rotating element 102 also drives the physical exercise surface 104 and the second rotating element 103 into rotation. In an entirely similar manner, the rotation of the second rotating element 103 drives the first rotating element 102 and the physical exercise surface 104 into rotation.

In an embodiment (not shown in the figure), the physical exercise surface 104 comprises a belt wound about the first rotating element 102 and the second rotating element 103 and a supporting table, arranged between the first rotating element 102 and the second rotating element along the longitudinal axis L of the base 101, on which the belt defining the physical exercise surface 104 runs.

In this embodiment, the first rotating element 102 and the second rotating element 103 comprise two respective rolls, each rotationally coupled to the base 101 of the treadmill 100 at the two ends of the base 101, to which the belt is connected.

According to a further embodiment, the physical exercise surface 104 comprises a plurality of slats transversal to the longitudinal axis L of the base 101, conferring a slat-like conformation to the physical exercise surface 104. In this embodiment, both the first rotating element 102 and the second rotating element 103 comprise two respective pulleys arranged near the side portions of the base 101, transversely to the longitudinal axis L of the base 101, adapted to support the plurality of slats at the side edges of each slat.

Furthermore, the physical exercise surface 104, at the side edges of the plurality of slats, is supported by respective side guides (also not shown) fixed to the base 101, each comprising a series of small rolls freely coupled to the base 101 on which the respective side edge of the plurality of slats runs.

It is worth noting that, according to alternative embodiments, in combination with the preceding one, the physical exercise surface 104, comprising the plurality of slats transverse to the longitudinal axis L of the base 101, may have a plane (parallel) side profile or a curved side profile, with respect to a reference plane, e.g. a supporting surface of the treadmill 100.

With reference again to the embodiment in FIG. 1 and to the embodiment in FIG. 2, the treadmill 100 further comprises an electric motor 105 operatively associated with at least either said first rotating element 102 or second rotating element 103.

Examples of motors may be electric brushless type motors, three-phase asynchronous electrical motors, variable reluctance electrical motors, direct current electrical motors, and so on.

It is worth noting that in the description which follows and in FIGS. 1 and 2, for convenience, the case in which the electric motor 105 is associated with the first rotating element 102 is considered, since the electric motor 105 could be associated with the second rotating element 103 in an equivalent and alternative manner.

The electric motor 105, operatively associated with and controllable by a data processing unit (described below), is configured to rotate the first rotating element 102 about the respective rotational axis, the first rotational axis A2. The rotation of the first rotating element 102 drives the physical exercise surface 104 into rotation, which rotates the second rotating element 103 in turn.

When the physical exercise surface 104 is moving, the forward direction of the physical exercise surface 104, indicated by reference S1 in FIGS. 1 and 2, is opposite to the forward direction of the user U, indicated in FIGS. 1 and 2 by reference S2.

The treadmill 100 further comprises a drive 105' operatively connected to the electric motor 105.

The drive 105' is configured to supply an electric current to the electric motor 105 to generate a torque adapted to move the physical exercise surface 104 so that the electric motor 105 and drive 105' assembly can correct the instantaneous rotation speed of the electric motor 105, which is inevitably disrupted by the interaction of the user U with the physical exercise surface 104 while performing the physical activity, returning it as close as possible to a reference instantaneous speed rotation value.

The treadmill 100 further comprises a data processing unit 106 operatively connected to the electric motor 105.

The treadmill 100 further comprises a memory unit 107, operatively connected to the data processing unit 106.

The memory unit 107 can be either internal or external (as shown in the FIGS. 1 and 2, for example) to the data processing unit 106.

It is worth noting that the memory unit 107 is configured to store one or more program codes which can be executed by the data processing unit 106 and data generated by said one or more program codes.

The data processing unit 106 is configured to execute a method for determining running phases of a user U on a treadmill 100 in accordance with the present invention, described below.

It is worth noting that the running phases of a user on a treadmill comprise a phase of flight of different feet, a phase of overstride, a phase of propulsion, a phase of contact, a phase of flight of the same foot (also defined and described in detail below).

In accordance with an embodiment (shown in FIGS. 1 and 2), the data processing unit 106 comprises a first data processing block 108, e.g. a microprocessor or a microcontroller, operatively connected to the electric motor 105.

It is worth noting that in this embodiment, the first data processing block 108 may coincide with the microprocessor of the drive 105' of the electric motor 105.

In this embodiment, the memory unit comprises a first memory block 109 operatively connected to the first data processing block 108.

In this embodiment, all the steps of the method for determining running phases of a user U on a treadmill 100 in accordance with the present invention, described below, are executed by the first data processing block 108, e.g. by the microcontroller of the drive 105' of the electric motor 105.

In accordance with a further embodiment, in combination with the preceding one (shown by dashed lines in FIGS. 1 and 2), the data processing unit 106 further comprises a second data processing block 110, e.g. a microprocessor or a microcontroller, operatively connected to the first data processing block 108.

The second data processing block 110 is remote with respect to the first data processing block 108.

For example, the second data processing block 110 may be positioned in a control electronics of the display or user interface of the treadmill 100.

In this embodiment, the memory unit comprises a second memory block 111 operatively connected to the second data processing block 110, also positioned in the control electronics of the display or user interface of the treadmill 100.

The data link between the first data processing block 108 and the second data processing block 110 may be wired or wireless (e.g. by means of Bluetooth, NFC or Wi-Fi type data communication channel).

In an embodiment, all the steps of the method for determining running phases of a user U on a treadmill 100 in accordance with the present invention, described below, are performed exclusively by the first data processing block 108, e.g. by the microcontroller of the drive 105' of the electric motor 105.

In a further embodiment, alternative to the preceding one, a first plurality of steps of the method for determining running phases of a user U on a treadmill 100 in accordance with the present invention are performed by the first data processing block 108 (e.g. by the microcontroller of the drive 105' of the electric motor 105), whilst a second plurality of steps, subsequent to the first plurality of steps, of the same method may be performed by the second data processing block 110, on the basis of the data processed and received from the first data processing block 108.

So, it is advantageously possible to reduce the task, from a computational point of view, of the first processing block 108 which, corresponding for example to the microcontroller of the drive of the treadmill 100, is configured to supply the electric current to the electric motor 105 to generate the torque adapted to move the physical exercise surface 104 so that the electric motor 105 and drive 105' assembly can correct the instantaneous rotation speed of the electric motor 105, inevitably disrupted by the interaction of the user U with the physical exercise surface 104 while performing the physical activity, returning it as close as possible to an instantaneous speed rotation reference value.

In accordance with a further embodiment, in combination with any one of those described above, shown in FIGS. 3, 4*a* and 4*b*, the treadmill 100 also comprises a frame 112 extending substantially in a vertical direction with respect to the base 101.

Figure 4B:
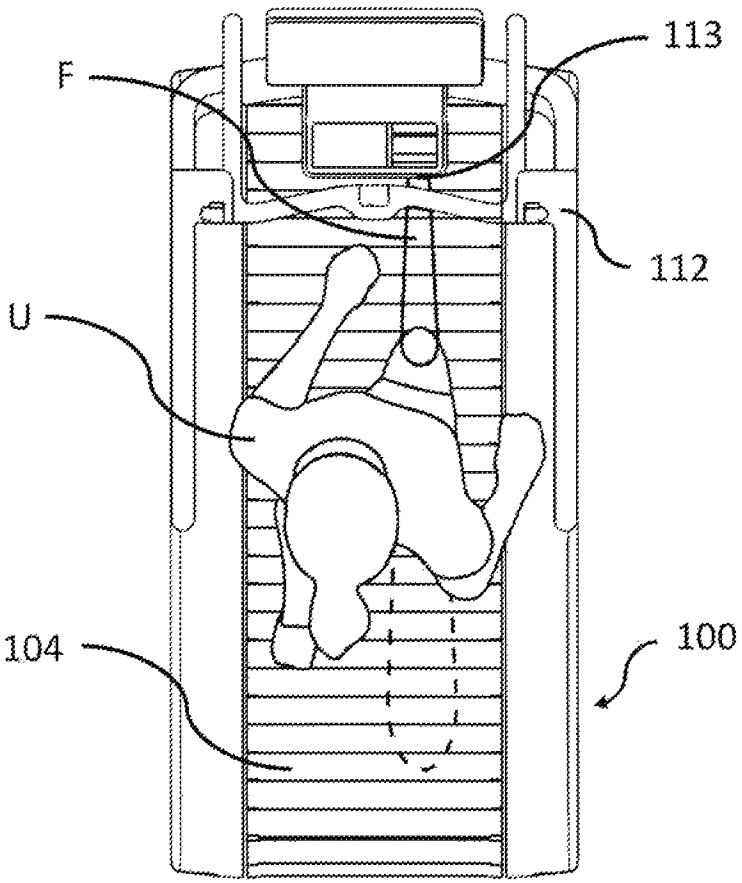
Figure 4A:
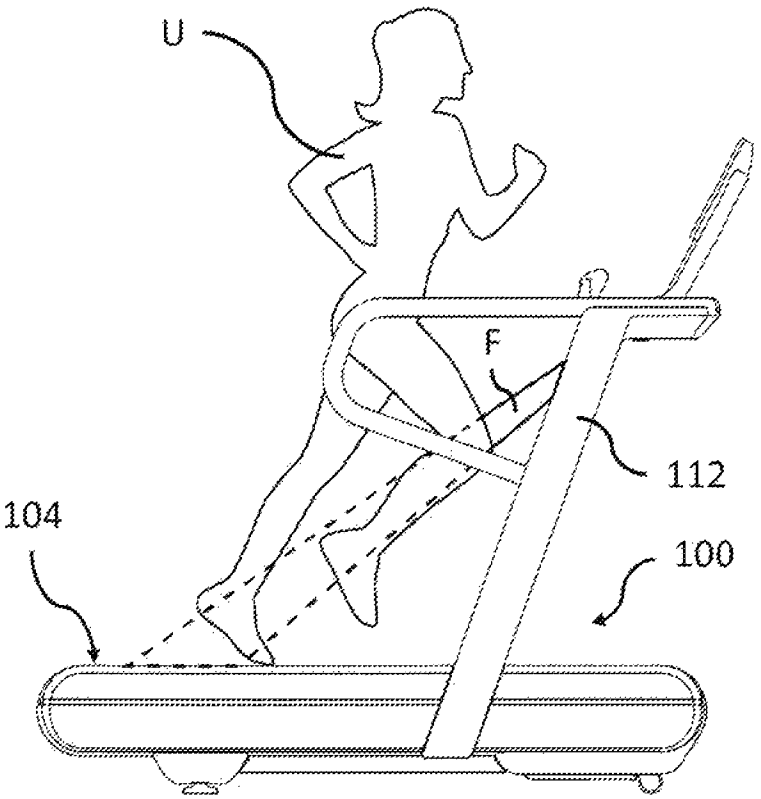

The frame 112 is a combination of uprights and tubular elements operatively connected to one another and distributed so as to define a supporting structure which at least in part surrounds the user U when he or she is on the physical exercise surface 104 (as shown in FIGS. 4*a* and 4*b*).

In accordance with a further embodiment, either in combination with or alternatively to any of those described above, shown for example in FIGS. 3, 4*a* and 4*b*, the treadmill 100 comprises at least one distance sensor 113, e.g. an infrared sensor, operatively connected to the data processing unit 106 (not shown in FIGS. 3, 4*a* and 4*b*).

The at least one distance sensor 113 is configured to detect a variation in the position of a portion (e.g. around the knee) of a set leg of the user U (right or left) with respect to a reference position, while performing the physical activity on the treadmill 100.

Figure 3:
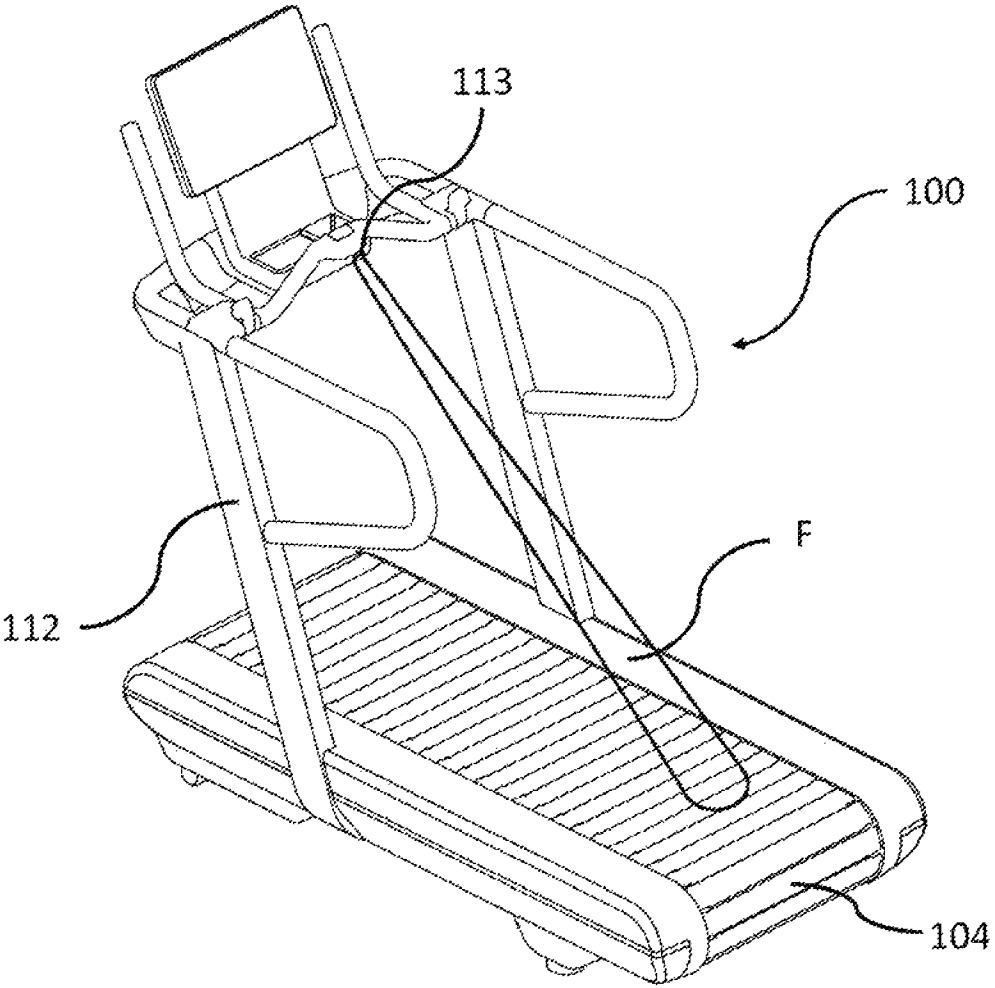
FIGS. 3, 4*a*, 4*b* show a perspective view, a side view and a top view of a treadmill according to a further embodiment of the present invention, respectively.

As shown in FIGS. 3, 4*a* and 4*b*, the at least one distance sensor 113 is for example fixed to the front part of the frame 112 of the treadmill 100 and is inclined at a predetermined angle, e.g. 45°, so that the emitted detection beam (indicated by reference F) strikes the user U and is reflected towards the detection region of said at least one distance sensor 113.

In greater detail, the at least one distance sensor 113 is preferably arranged on a side of the treadmill 100 so as to detect the variation of the position of a portion of a set leg of the user U with respect to a reference position (represented by said at least one distance sensor 113).

As shown by way of example in FIGS. 3, 4*a* and 4*b*, the at least one distance sensor 113 is on the right side and is configured to detect the variation of the position of the portion around the knee of the right leg of the user U.

FIGS. 4*a* and 4*b* show the user in the moment of the end of the phase of contact of the left foot with the physical exercise surface 104 ("toe off" of the left foot) which is followed by the beginning of the phase of flight of the left foot, in which there is no contact with the physical exercise surface 104 of the treadmill 100. The phase of flight ends with the beginning of the phase of contact of the right foot with the physical exercise surface 104 of the treadmill 100 ("heel strike" of the right foot).

In this case, in the interval of time preceding the beginning of the phase of contact of the right foot with the physical exercise surface 104 of the treadmill 100, the at least one distance sensor 113 is adapted to detect a decrease over time of the distance of the portion of the right leg.

As described below, the variation of the position of a portion of a set leg of the user U may be employed by the data processing unit 106 while executing the method for determining running phases of a user on a treadmill according to the present invention, in which a determined running phase may be indeed associated with a change of position of a portion of a set leg of the user.

By way of example, again with reference to the example in FIGS. 3, 4*a* and 4*b*, the data processing unit 106 is configured for example to associate the beginning of the phase of contact with the physical exercise surface 104 of the treadmill 100 with the right foot, on the basis of the position detected by the at least one distance sensor 113.

In an embodiment, in combination with or alternatively to the preceding one, said at least one distance sensor 113 may be configured to detect the position variation of a portion of both the legs of the user U with respect to a respective reference position (e.g. represented by said at least one distance sensor 113).

In a further embodiment, alternative to those described above, the treadmill 100 may comprise at least one pair of distance sensors of the type described above, one arranged on the right side of the treadmill 100 and one arranged on the left side of the treadmill 100.

Turning back now in general to the treadmill 100, it is worth noting that, in greater detail, the data processing unit 106 is advantageously configured to determine a magnitude variable over time correlated to the interaction of the user U with the physical exercise surface 104 while performing the physical activity, such as running.

Indeed, the Applicant has monitored in a synchronized manner a video recording of a plurality of sample users running on the treadmill 100 and the aforesaid magnitude variable over time, according to various embodiments, noting a correlation between the trend over time of such a magnitude variable over time and the running on the treadmill 100 of the plurality of sample users, thus with the interaction of a user U with the physical exercise surface 104 while running.

The Applicant also observes that the interaction of the user U with the physical exercise surface 104 can be subdivided into the running phases of the user U on the physical exercise surface 104 of the treadmill 100, such as a phase of flight between different feet, a phase of overstride, a phase of propulsion, a phase of contact by the same foot, a phase of flight of the same foot.

So, the magnitude variable over time correlated to the interaction of the user U with the physical exercise surface 104 while performing the physical activity, which can be determined by the data processing unit 106, is also correlated to the running phases of the user U on the physical exercise surface 104 of the treadmill 100.

As previously mentioned, the running phases include:

a phase of flight between different feet, i.e. a running phase between when the last portion of a foot is off the physical exercise surface and the successive contact between the first portion of the other foot and the physical exercise surface;

a phase of overstride, i.e. a running phase between the contact between the first portion of a foot and the physical exercise surface and the moment in which the vertical line passing through the center of gravity of the body of the user U intersects a contact portion of the same foot with the physical exercise surface;

a phase of propulsion, i.e. a running phase between the moment in which the vertical line passing through the center of gravity of the body of the user U intersects a contact portion of the foot with the physical exercise surface and between when the last portion of a foot is off the physical exercise surface;

a phase of flight of the same foot, i.e. a running phase between when the last portion of a foot is off the physical exercise surface and the successive contact between the first portion of the same foot and the physical exercise surface.

Turning back to the magnitude variable over time, it will be described in greater detail below in the description of the method according to the present invention with particular reference also to FIGS. 8-10.

Figure 5:
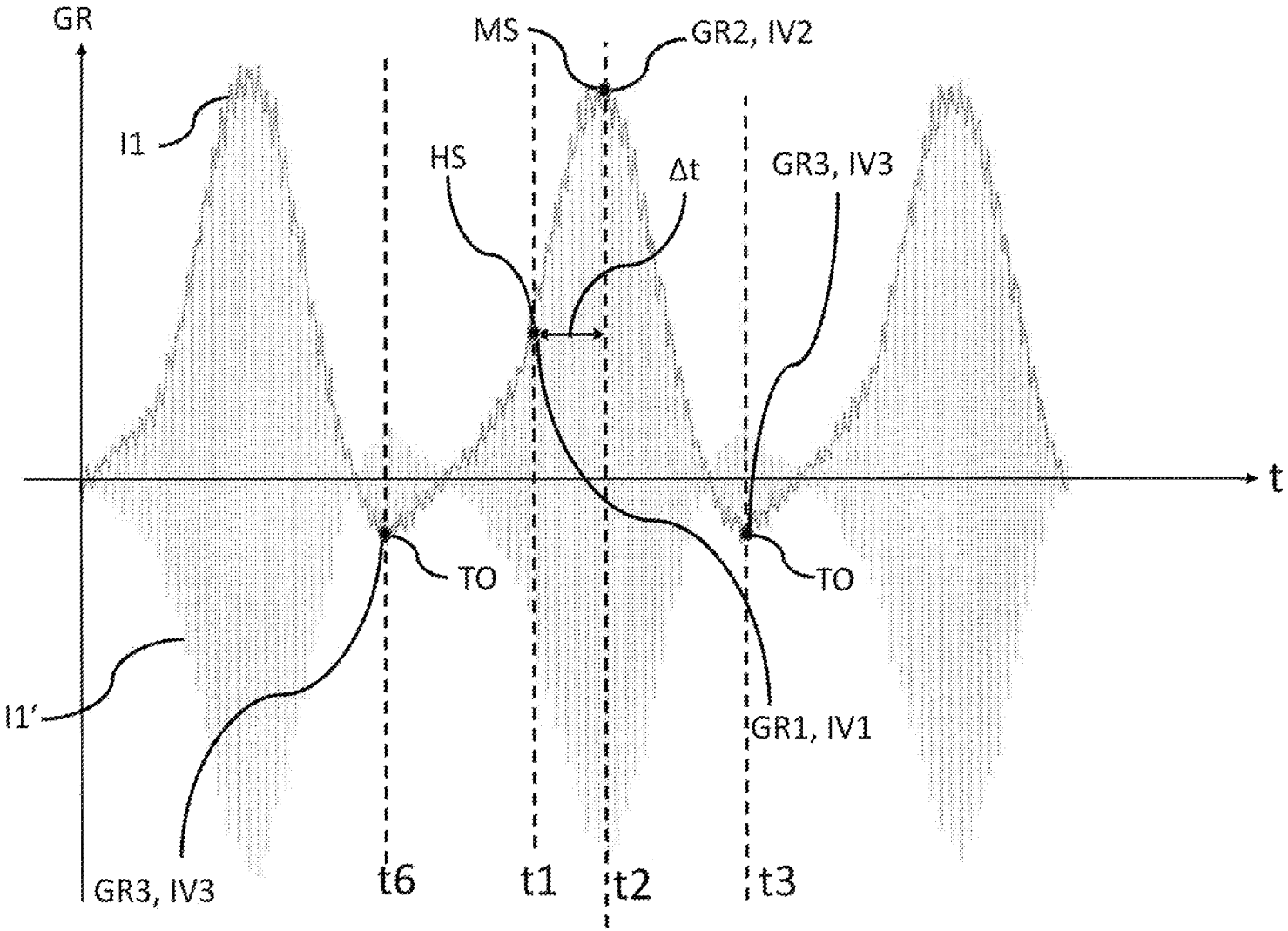
FIG. 5 shows, by means of a chart, a magnitude variable over time correlated to the use of the treadmill by the user for physical activity, which can be determined by the method for determining running phases of a user on a treadmill, according to an embodiment of the present invention.

In an embodiment of the treadmill 100, e.g. shown in FIG. 1, this magnitude variable over time correlated to the interaction of the user U with the physical exercise surface 104 while performing the physical activity is a first absorption electric current of the electric motor 105, indicated by reference I1 in FIG. 5.

In greater detail, as clearly shown in FIG. 5, the first absorption electric current I1 of the electric motor 105 is an envelope of an operating electric current I1' of the electric motor (e.g. the motor phase current), having a respective frequency modulation.

In this embodiment (FIG. 1), the first absorption electric current I1 of the electric motor 105 is detected by the data processing unit 106.

Indeed, the data processing unit 106, during the normal operation of the treadmill 100, generates electric voltage and electric current on the motor 105 to control it, so that the data processing unit 106 can know its values directly.

In this regard, the treadmill 100 may comprise a respective detection unit of the first absorption electric current I1 of the electric motor 105 (not shown in the figures), operatively connected to the electric motor 105 and operatively associated with the data processing unit 106.

For example, this measurement unit is one or more electric current sensors.

In an embodiment shown, the detection unit is integrated in the data processing unit 106.

In a further embodiment, alternative to the preceding one, the detection unit is external to the data processing unit 106.

In this embodiment, the treadmill 100 comprises a first data communication module (not shown in the figures) operatively associated with the data processing module 106 and a second data commutation module (also not shown in the figures) operatively connected to the detection unit, both configured to communicate with one another by means of a data communication channel of the wireless type (e.g. a Bluetooth, NFC or Wi-Fi type data communication channel) or by means of a data connection channel of the wired type.

According to a further embodiment, shown in FIG. 2, either in combination with or alternatively to the preceding one, the magnitude variable over time correlated to the interaction of the user U with the physical exercise surface 104 while performing the physical activity is the first absorption electric current I1 of the electric motor 105.

In this embodiment, the electric motor 105 is preferably a three-phase motor supplied by a triad of supply currents.

In this embodiment, the treadmill 100 comprises at least one speed sensor 114 operatively connected to the electric motor 105 and to the data processing unit 106.

The at least one speed sensor 114 is adapted to detect the rotation speed of the electric motor 105 which can be used by the data processing unit 106, as described below, to determine the first absorption electric current I1 of the electric motor 105 as a function of the variation over time of the speed detected by at least one speed sensor 114 and by the triad of supply currents of the electric motor 105 of three-phase type.

For example, the at least one speed sensor 114 is an encoder seated onto the drive shaft of the electric motor 105.

The encoder, e.g. of the optical or magnetic or other technical equivalent type, is adapted to detect the angular speed of the electric motor 105 which is correlated with the angular speed of said at least one first rotating element 102 and at least one second rotating element 103 to which the physical exercise surface 104 is connected. The angular speed of said at least a first rotating element 102 and at least one second rotating element 103 is correlated with the linear displacement speed of the physical exercise surface 104.

In this embodiment, the electric motor 105 of three-phase type can be compared, from a mathematical point of view, by means of mathematical transforms (intrinsically known), to an electric motor model of the two-phase type having two electric current components, in which the first component (usually indicated by Id) is adapted to generate the flow of electric current, while the second component (usually indicated with Iq) is adapted to generate the torque. The second electric current component corresponds to the first absorption electric current I1 of the electric motor 105.

It is also worth noting that in addition to the encoder, other examples of speed sensors may be any sensor adapted to detect a magnitude of the processing from which it is possible to determine the angular speed, such as an accelerometer, a gyroscope, a combination of these or other equivalent technical and so on.

Figure 6:
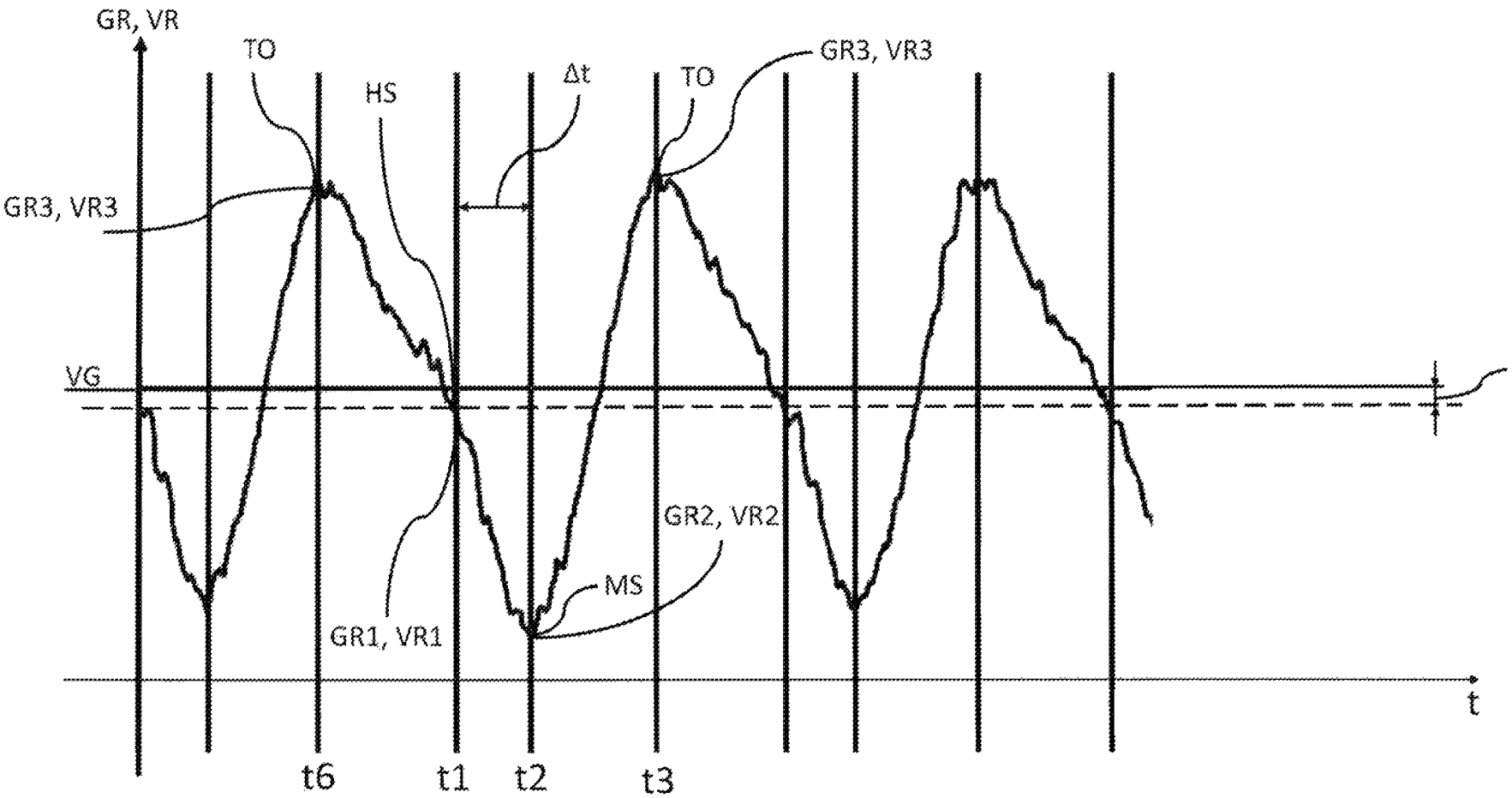
FIG. 6 shows, by means of a chart, a further magnitude variable over time correlated to the use of the treadmill by the user for physical activity, which can be determined by the method for determining running phases of a user on a treadmill, according to a further embodiment of the present invention.

In a further embodiment, also shown in FIG. 2, alternatively to the preceding ones, the magnitude variable over time correlated with the interaction of the user U with the physical exercise surface 104 while performing the physical activity is the instantaneous rotation speed of the electric motor 105, indicated by reference VR in FIG. 6.

In this embodiment, the treadmill 100 comprises at least one speed sensor 114 operatively connected to the electric motor 105 and to the data processing unit 106.

Examples of said at least one speed sensor 114 were previously provided with reference to the preceding embodiment of the treadmill 100.

In this embodiment, the magnitude variable over time correlated to the interaction of the user U with the physical exercise surface 104 while performing the physical activity is directly the instantaneous rotation speed VR of the electric motor 105 detected by at least one speed sensor 114, as will be explained below in detail.

With reference now also to FIGS. 5-10, a method for determining running phases of user U on a treadmill 100, hereinafter also simply method, will now be described according to different embodiments.

Firstly, with reference in particular to FIGS. 5 and 6, the Applicant observes that the interaction of the user U with the physical exercise surface 104 of the treadmill 100 can be represented by a magnitude GR detectable on the treadmill 100, the variation of which over time is precisely correlated to the interaction of the user U with the physical exercise surface 104 while performing the physical activity.

As mentioned above, the Applicant has monitored in a synchronized manner a video recording the running pace on the treadmill 100 of a plurality of sample users and the aforesaid magnitude variable over time, according to different embodiments, noting a correlation between the trend over time of such a magnitude variable over time and the running pace on the treadmill of the plurality of sample users, thus the interaction of a user U with the physical exercise surface 104 while running.

In particular, it is worth reasserting that the interaction of the user U with the physical exercise surface 104 can be subdivided into the running phases of the user U on the physical exercise surface 104 of the treadmill 100.

The running phases comprise a phase of flight between two different feet, a phase of overstride, a phase of propulsion, a phase of contact by the same foot, a phase of flight of the same foot (as defined above).

In more detail, it is worth noting that the Applicant has observed a set correspondence between the running phases into which the interaction of a user U with the physical exercise surface 104 can be subdivided while performing the physical activity (running) and a plurality of points (which can be defined as characteristic) of the trend over time of such a magnitude variable over time.

In greater detail, the magnitude GR variable over time has a substantially periodic trend.

In this regard, the Applicant observes that on the periodic trend of such a magnitude GR variable over time it is possible to identify a set time instant of each point of said plurality of points, from the processing of which running phases of the user U on the treadmill 100 can be obtained. It is worth noting that in the respective time instant, each point of the plurality of points has a set value.

The running phases into which the interaction of a user U with the physical exercise surface 104 can be subdivided while performing the physical activity and the plurality of (characteristic) points of the trend over time of such a magnitude variable over time will be described below.

With general reference to both FIG. 5 and FIG. 6, the plurality of points of the periodic trend of the magnitude GR variable over time comprises a first point HS in a first time instant t1. The first point HS has a first value GR1 in the first time instant t1.

The first point HS is representative of an interaction of a portion of a foot of the user U with the physical exercise surface 104, at the beginning of the interaction of the foot of the user U with the physical exercise surface 104.

In other words, the first time instant t1 of the first point HS (Heel Strike) is representative of the instant of impact on the physical exercise surface 104 of a portion of the foot, such as the first contact between the foot and the physical exercise surface 104.

Such an impact (incorrectly) occurs with the heel of the foot in case of unacceptable overstride in the pace of the user U, and it (correctly) occurs with the forefoot (slightly supine) if the acceptable overstride in the pace of the user U is acceptable.

The plurality of points of the periodic trend of the magnitude GR variable over time also comprises a second point MS in a second time instant t2 representative of an interaction of a foot of the user U with the physical exercise surface 104 in which the vertical line passing through the center of gravity of the body of the user U intersects a contact portion of the foot with the physical exercise surface 104. The second point MS has a second value GR2 in the second time instant t2.

It is worth noting that such a contact portion of the foot with the physical exercise surface 104 is typically the forefoot.

It is worth noting that the interaction of the contact portion of the foot with the physical exercise surface 104 allows the user U to apply the maximum pressure on the physical exercise surface 104.

In other words, the foot can apply the maximum pressure on the physical exercise surface 104, whereby starting the phase of propulsion.

Indeed, the second time instant t2 of the second point MS (mid stance) represents the instant of median resting of the foot, i.e. the phase in which the foot is under the vertical line passing through the center of gravity of the body of the user U.

In this case, the forefoot completely rests on the physical exercise surface 104 and the center of gravity of the body of the user U is located closest to the physical exercise surface during its vertical oscillation.

The plurality of points of the periodic trend of the magnitude GR variable over time also comprises a third point TO in a third time instant t3. The third point TO has a third value GR3 in the third time instant t3.

It is worth noting that the first value GR1 of the first point HS is comprised between the third value GR3 of the third point TO and the second value GR2 of second point MS.

The third time instant t3 of the third point TO is representative of the instant of interaction of a portion of a foot of the user U on the physical exercise surface 104, before the foot is off the physical exercise surface 104 (beginning of phase of flight of the foot or beginning of the phase of flight between two different feet).

In other words, in the third point TO, the foot applies the minimum pressure on the physical exercise surface 104 before starting the phase of flight.

It is worth noting that the third point TO (toe off) represents the end of the phase of contact of the foot (and thus the end of the phase of propulsion) and the beginning of the phase of flight of the foot.

It is worth noting that the plurality of points of the periodic trend over time of the magnitude GR variable over time comprises in succession a first point HS, a second point MS and a third point TO for one foot, a first point HS, a second point MS and a third point TO for a successive foot and so on.

In other words, the first point HS, the second point MS and the third point TO recur periodically over time, referring alternatively firstly to one foot (e.g. the right foot), then to the other (e.g. the left foot).

So, the mutually consecutive two first points HS, two second points MS or two third points TO relate to one foot and to the other, respectively.

Figure 7:
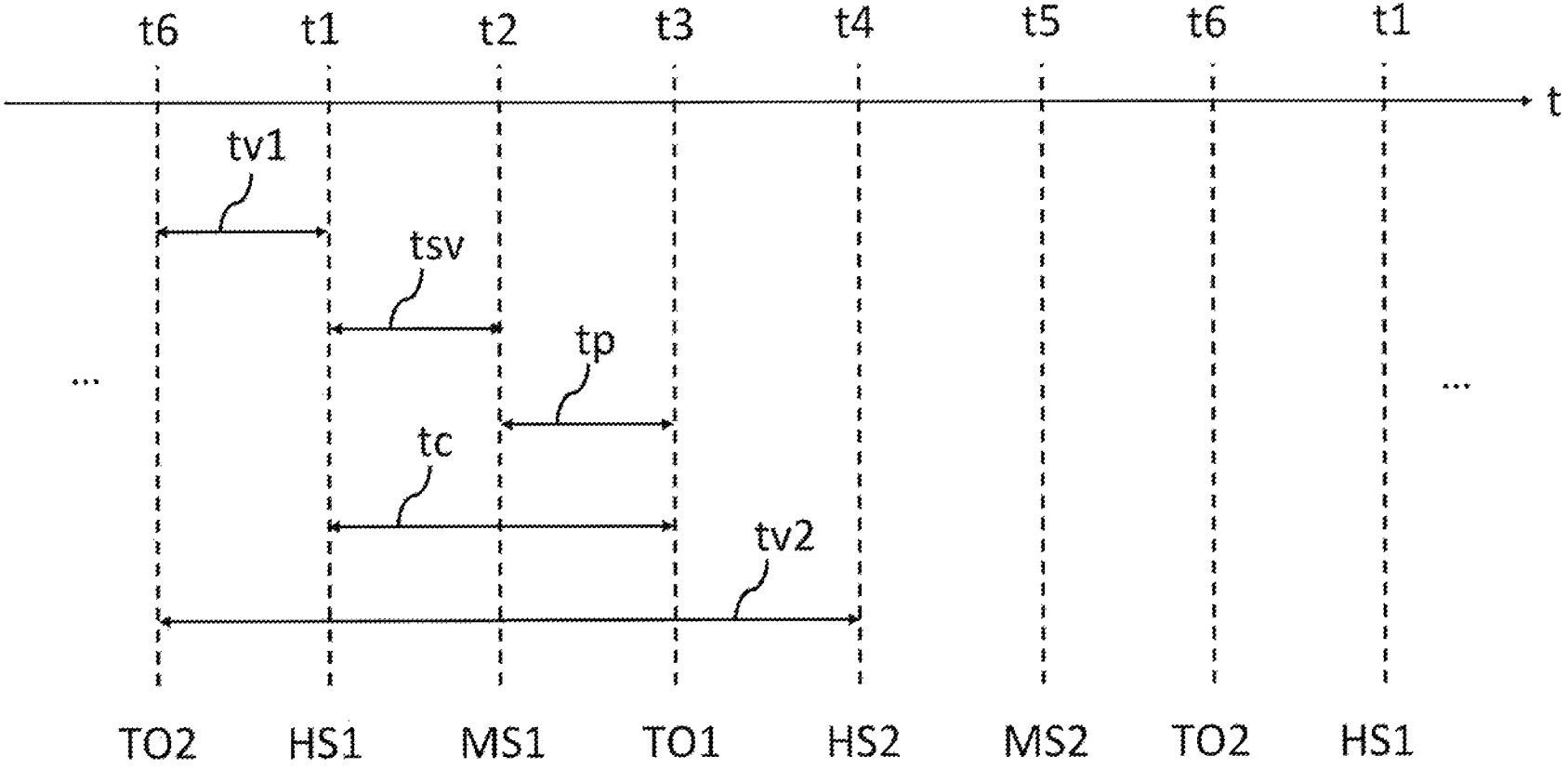
FIG. 7 shows, by means of a time chart, running phases of a user on a treadmill.

By way of example, the following points are shown in the chart in FIG. 7:

a) first point HS1 of one foot at a time instant t1;
b) second point MS1 of the same foot at a time instant t2;
c) third point TO1 of the same foot at a time instant t3;
d) first point HS2 of a successive foot in a time instant t4;
e) second point MS2 of the same foot at a time instant t5;
f) third point HS2 of the same foot at a time instant t6.

The sequence a)-f) is repeated.

It is also worth noting that FIGS. 5 and 6 for simplicity of description, as will be explained below, show the first point HS of one foot (in a first time instant t1), the second point MS (in a second time instant t2) of the same foot, the third point TO of the same foot (in a third time instant t3) but also the third point TO of the preceding foot (in a further time instant t6).

So, as shown in FIGS. 5 and 6, the first instant t1 of the first point HS is comprised between the further time instant t6 of the third point TO and the second time instant t2 of the second point MS.

Turning back in general to the present invention, it is worth noting that the essential components of the interaction of a user U with the physical exercise surface 104 are:

the interaction of a portion of a foot of the user U with the physical exercise surface 104, at the beginning of the interaction of the foot of the user U with the physical exercise surface 104 (corresponding to the first point HS: beginning of the phase of overstride; end of the phase of flight between different feet; end of the phase of flight of the same foot);

the interaction of a portion of a foot of the user U with the physical exercise surface 104, in which the vertical passing through the center of gravity of the body of the user U intersects with contact portion of the foot (forefoot) with the physical exercise surface 104 (corresponding to the second point MS: beginning of the phase of propulsion; end of the phase of overstride);

the interaction of a portion of a foot of the user U with the physical exercise surface 104, before the foot is off the physical exercise surface 104 (corresponding to the third point TO: beginning of the phase of flight between different feet or beginning of the phase of flight of the same foot).

With reference again to FIG. 7, the running phases of a user U on the physical exercise surface 104, defined above, can thus be identified:

phase of flight between different feet (indicated by reference tv1): time distance between the time instant t1 of the first point HS1 of a foot and the time instant t6 of the third point TO2 of the preceding foot;

phase of overstride (indicated by reference tsv): time distance between the time instant t2 of the first point MS1 of a foot and the time instant t1 of the first point HS1 of the same foot;

phase of propulsion (indicated by reference tp): time distance between the time instant t3 of the third point TO1 of a foot and the time instant t2 of the second point MS1 of the same foot;

phase of contact by the same foot (indicated by reference tc): time distance between the time instant t3 of the third point TO1 of a foot and the time instant t1 of the first point HS1 of the same foot;

phase of flight of the same foot (indicated by reference tv2): time distance between the time instant of the first point HS2 of a foot and the time instant t6 of the third point TO2 of the same foot.

Relatively to the phase of overstride, it is worth noting that if the respective time distance is under a set threshold value, the overstride is considered acceptable, whilst if the respective time distance is over the set threshold value, the overstride is considered unacceptable.

With particular reference to FIG. 5, the magnitude GR detectable on the treadmill 100 the variation over time of which is correlated to the interaction of the user U with the physical exercise surface 104 while performing the physical activity is the first absorption electric current I1 of the electric motor 105.

The first absorption electric current I1 of the electric motor 105, supplied by the drive 105', is proportional to the torque required by the electric motor 105 to maintain the instantaneous rotation speed equal to a reference rotation speed value (speed set for the physical activity on the treadmill 100).

The methods for determining the first absorption electric current I1 of the electric motor 105 will be described below when describing of the method according to the present invention.

As shown in FIG. 5, the first absorption electric current I1 of the electric motor 105 has a substantially periodic trend over time.

The periodic trend of the first absorption electric current I1 of the electric motor 105 comprises a first point HS in a first time instant t1. The first point HS has a first value IV1.

The first time instant t1 of the first point HS is representative of the instant of interaction of a portion of a foot of the user U with the physical exercise surface 104, at the beginning of the interaction of the foot of the user U with the physical exercise surface 104 (beginning of the phase of overstride, beginning of the phase of contact by the same foot).

In greater detail, the first point HS represents the inflection point of the periodic trend over time of the first absorption electric current I1 of the electric motor 105 between its minimum value (third point TO, defined below) and its maximum value (second point MS, also defined below).

The methods for determining the first point HS (inflection point) of the first absorption electric current I1 of the electric motor 105 will be described below when describing the method according to the present invention.

Further considerations on the first point HS, the second point MS and the third point TO (characteristic points) of the first absorption electric current I1 of the electric motor 105, were described above with reference to the magnitude GR variable over time and therefore will not repeated here.

Turning back to FIG. 5, the periodic trend of the first absorption electric current I1 of the electric motor 105 further comprises a second point MS in a second time instant t2 successive to the first time instant t1.

The second time instant t2 of the second point MS is representative of the instant of interaction of the foot of the user U with the physical exercise surface 104, in which the vertical passing through the center of gravity of the body of the user U intersects a contact portion of the foot (forefoot) with the physical exercise surface 104 (end of the phase of overstride, beginning of the phase of propulsion). The second point MS has a second value IV2.

It is worth reasserting that the interaction of the contact portion of the foot with the physical exercise surface 104 allows the user U to apply maximum pressure on the physical exercise surface 104.

With reference again to FIG. 5, the periodic trend of the first absorption electric current I1 of the electric motor 105 comprises a further third point TO in a further time instant t6. The further third point TO has a third value IV3.

The first value IV1 of first point HS is comprised between the third value IV3 of the third point TO and the second value IV2 of second point MS.

The first time instant t1 is instead between the further time instant t6 and the second time instant t2.

The further time instant t6 of the third point TO is representative of the instant of interaction of a portion of a foot of the user U on the physical exercise surface 104, before such a foot is off the physical exercise surface 104 (beginning of phase of flight between two different feet, beginning of the phase of flight of the same foot).

In other words, in the further third point TO, the foot applies the minimum pressure on the physical exercise surface 104 before starting the phase of flight.

So, the phase of flight tv1 (FIG. 7) between two different feet occurs between a time instant in which the preceding foot end applying pressure on the physical exercise surface 104 and a time instant in which the other foot begins to apply pressure on the physical exercise surface 104.

Moreover, the phase of flight tv2 (FIG. 7) of the same foot occurs between a time instant in which the foot end applying pressure on the physical exercise surface 104 and a time instant in which the foot begins to apply pressure on the physical exercise surface 104.

Turning back to FIG. 5, the second value IV2 in the second time instant t2 of the first absorption electric current I1 of the electric motor 105 is the maximum value.

Indeed, in the moment in which the pressure applied by the foot on the physical exercise surface 104 is maximum (i.e. before the beginning of the phase of propulsion of the foot), thus in the presence of a significant disturbance due to the interaction of the user U with the physical exercise surface 104, the first absorption electric current I1 of the electric motor 105 absorbed by the electric motor 105 is maximum.

As apparent from FIG. 5, the third value IV3 in the further time instant t3 of the first absorption electric current I1 of the electric motor 105 is the minimum value, instead.

Indeed, in the moment in which the pressure applied by the preceding foot on the physical exercise surface 104 is minimum (just before the preceding foot is off physical exercise surface 104, i.e. before the beginning of the phase of flight between the preceding foot and the other foot or the beginning of the phase of flight of the same preceding foot), thus in absence of a significant disturbance due to the interaction of the user U with the physical exercise surface 104, the first absorption electric current I1 of the electric motor 105 absorbed by the electric motor 105 is minimum.

With reference again to FIG. 5, as mentioned above, the first point HS represents the inflection point of the periodic trend over time of the first absorption electric current I1 of the electric motor 105 between its minimum value (further third point TO) and its maximum value (second point MS).

It is worth noting that FIG. 5 may be used to illustrate an example of trend of the variable magnitude over time correlated to the interaction of the user U with the physical exercise surface 104 while performing the physical activity if it is the first absorption electric current I1 of the electric motor 105 determined as a function of the time trend of the speed detected by at least one speed sensor 114 and by the triad of supply currents of the electric motor 105 of the three-phase type, as described previously.

With particular reference to FIG. 6, the magnitude GR detectable on the treadmill 100, the variation over time of which is correlated to the interaction of the user U with the physical exercise surface 104 while performing the physical activity, is the instantaneous rotation speed VR of the electric motor 105.

Indeed, the Applicant has noted the correction performed by the electric motor 105 and drive 105' assembly on the instantaneous rotation speed VR of the electric motor 105 in order to take it back as close as possible to a reference instantaneous rotation speed value, noting the periodic trend over time of the instantaneous rotation speed VR of the electric motor 105 from which it is possible to determine the characteristic points of interest, such as those defined above with general reference to both FIGS. 5 and 6.

The methods for determining the instantaneous rotation speed VR of the electric motor 105 will be described below when describing the method according to the present invention.

As shown in FIG. 6, the instantaneous rotation speed VR of the electric motor 105 has a substantially periodic trend over time.

The periodic trend over time of the instantaneous rotation speed VR of the electric motor 105 comprises a first point HS in a first time instant t1. The first point HS has a first value VR1.

The first time instant t1 of the first point HS is representative of the instant of interaction of a portion of a foot of the user U with the physical exercise surface 104, at the beginning of the interaction of the foot of the user U with the physical exercise surface 104 (beginning of the phase of overstride, beginning of the phase of contact by the same foot).

In greater detail, the first point HS represents the inflection point of the periodic trend over time of the instantaneous rotation speed VR of the electric motor 105 between its maximum value (further third point TO, defined below) and its minimum value (second point MS, defined below).

Furthermore, the Applicant has observed that the first point HS represents the instantaneous decrease point of the periodic trend over time of the instantaneous rotation speed VR of the electric motor 105 between its maximum value (further third point TO, defined below) and its minimum value (second point MS) with respect to a reference instantaneous rotation speed value VG.

The methods for determining the first point HS of the instantaneous rotation speed VR of the electric motor 105 will be described below when describing the method according to the present invention.

Turning back to FIG. 6, the periodic trend of the instantaneous rotation speed VR of the electric motor 105 further comprises a second point MS in a second time instant t2 successive to the first time instant t1. The second point MS has a second value VR2.

The second time instant t2 of the second point MS is representative of the instant of interaction of the foot of the user U with the physical exercise surface 104, in which the vertical passing through the center of gravity of the body of the user U intersects with contact portion of the foot with the physical exercise surface 104 (end of the phase of overstride, beginning of the phase of propulsion).

It is worth noting that the interaction of the contact portion of the foot with the physical exercise surface 104 allows the user U to apply maximum pressure on the physical exercise surface 104.

In other words, the foot, in the second point MS, can apply maximum pressure on the physical exercise surface 104, whereby starting the phase of propulsion.

With reference again to FIG. 6, the periodic trend over time of the instantaneous rotation speed VR of the electric motor 105 comprises a further third point TO in a further time instant t6. The third point TO has a third value VR3.

It is worth noting that the first value VR1 of first point HS is comprised between the further third value VR3 of the further third point TO and the second value VR2 of second point MS.

The first time instant t1 is between the further time instant t6 and the second time instant t2.

The further third time instant t6 of the further third point TO is representative of the instant of interaction of a portion of a foot of the user U on the physical exercise surface 104, before the preceding foot is off the physical exercise surface 104 (beginning of phase of flight between two different feet, beginning of the phase of flight of the same foot, e.g. of the preceding foot).

In other words, in the further third point TO, the preceding foot applies the minimum pressure on the physical exercise surface 104 before starting the phase of flight.

As apparent from FIG. 6, the second value VR2 in the second time instant t2 of the instantaneous rotation speed VR of the electric motor 105 is the minimum value.

Indeed, in the moment in which the pressure applied by the foot on the physical exercise surface 104 is maximum (i.e. before the beginning of the phase of propulsion of the foot), thus in the presence of a significant disturbance due to the interaction of the user U with the physical exercise surface 104, the instantaneous rotation speed VR of the electric motor 105 is minimum.

In other words, the physical exercise surface 104 undergoes a deceleration due to the interaction of the user U with it.

As apparent again from FIG. 6, the third value VR3 in the further third time instant t6 of the instantaneous rotation speed VR of the electric motor 105 is the maximum value.

Indeed, in the moment in which the pressure applied by the preceding foot on the physical exercise surface 104 is minimum (just before the preceding foot is off the physical exercise surface 104, i.e. before the phase of flight between the preceding foot and the other foot or before the phase of flight of the same preceding foot), thus in absence of a significant disturbance due to the interaction of the user U with the physical exercise surface 104, the instantaneous rotation speed VR of the electric motor 105 is maximum, because the physical exercise surface 104 is subject to the acceleration due to the interaction of the user U (by means of the preceding foot) with the physical exercise surface 104.

In other words, the physical exercise surface 104 does not undergo any deceleration due to the interaction of the user U with it.

Further considerations on the first point HS, the second point MS and the further third point TO were described above with reference to the magnitude GR variable over time and therefore will not repeated here.

Figure 8:
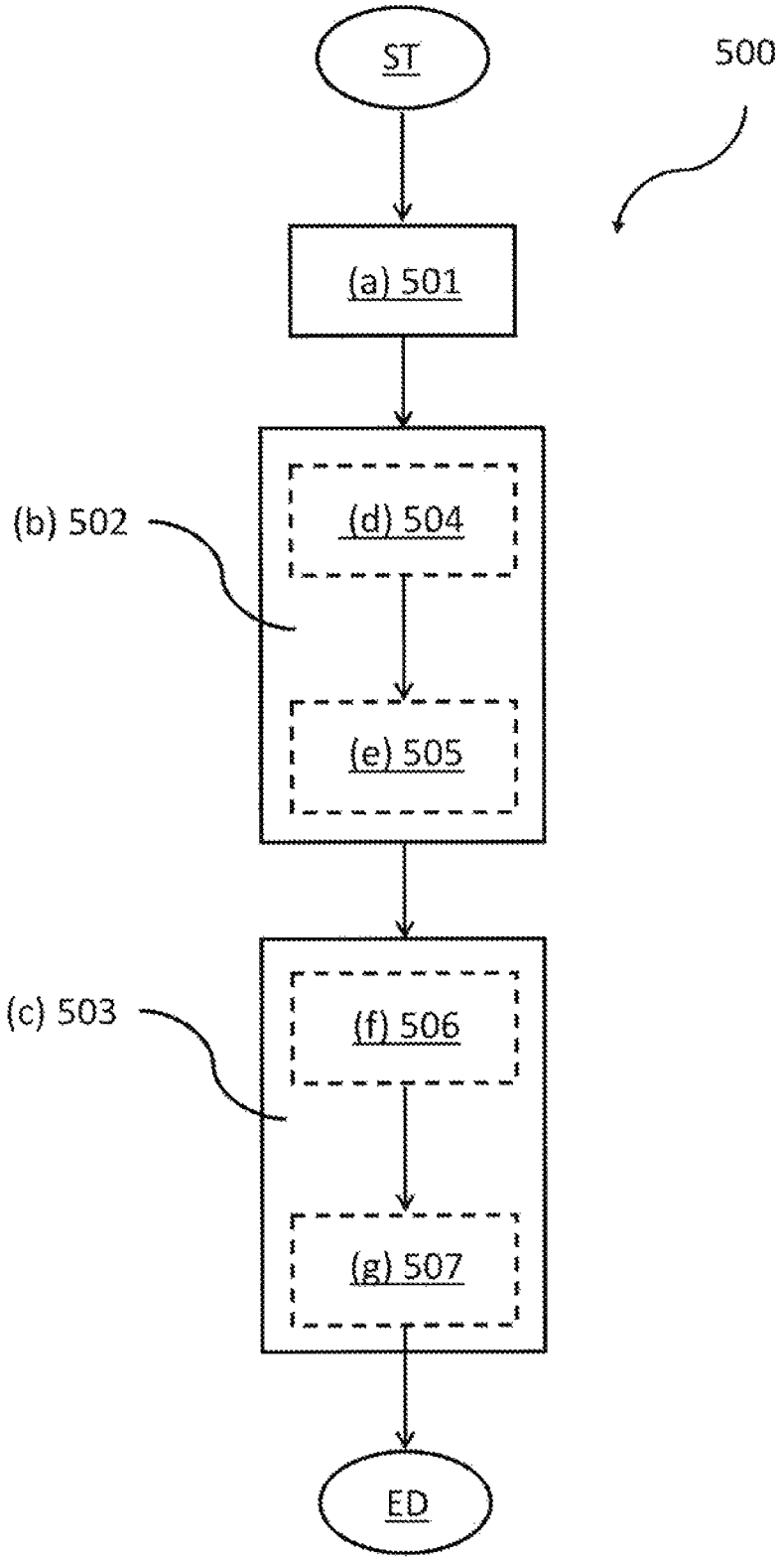
FIGS. 8-10 show, by means of respective block charts, a method for determining running phases of a user on a treadmill, in accordance with various embodiments of the present invention.

With reference now also to FIG. 8, a method 500 for determining the running phases of user U on a treadmill 100, hereinafter also simply method, will now be described according to an embodiment according to the present invention.

As mentioned above, the treadmill 100 comprises a base 101 extending along a longitudinal axis L.

The base 101 comprises a first rotating element 102 and a second rotating element 103 adapted to rotate about respective rotational axes A2, A3 transverse to the longitudinal axis L of the base 101.

The base 101 comprises a physical exercise surface 104 operatively connected to the first rotating element 102 and to the second rotating element 103.

The treadmill 100 further comprises an electric motor 105 operatively associated with at least said either first rotating element 102 or second rotating element 103. The electric motor 105 is configured to rotate the at least one first rotating element 102 and the at least one second rotating element 103 by driving also the physical exercise surface 104 into rotation.

The treadmill 100 further comprises a data processing unit 106 operatively connected to the electric motor 105. The data processing unit 106 is configured to control said electric motor 105.

Turning back to FIG. 8, the method 500 comprises a symbolic step of starting ST.

The method 500 comprises a step of (a) determining 501, by the data processing unit 106, a magnitude GR variable over time correlated to the interaction of the user U with the physical exercise surface 104 while performing the physical activity.

The magnitude GR variable over time has a substantially periodic trend.

The method 500 further comprises a step of (b) determining 502, by the data processing unit 106, respective time instants t1, t2, t3 of at least two points among a plurality of points HS, MS, TO of the periodic trend of the magnitude GR variable over time.

Each point of said plurality of points HS, MS, TO has a respective value GR1, GR2, GR3.

The respective time instant t1, t2, t3 of each point of said plurality of points HS, MS, TO are representative of instants of interaction of the user U with the physical exercise surface 104 of the treadmill 100 while running.

The method 500 further comprises a step of (c) determining 503, by the data processing unit 106, at least one running phase of the user U on the physical exercise surface 104 of the treadmill 100 on the basis of the respective time instants t1, t2, t3 of said at least two points determined from the plurality of points HS, MS, TO of the periodic trend of the magnitude GR variable over time.

The at least one running phase of a user U on the physical exercise surface 104 of the treadmill 100 is comprised within a plurality of running phases comprising: phase of flight between different feet; phase of overstride; phase of propulsion; phase of contact by the same foot; phase of flight of the same foot.

The method comprises a symbolic step of ending ED.

In an embodiment, in combination with the preceding one, shown by dashed lines in FIG. 8, the step of (b) determining 502 comprises a step of (d) determining 504, by the data processing unit 106, a first time instant t1 of a first point HS of the periodic trend of the magnitude GR variable over time.

The first point HS has a first value GR1 in the first time instant t1.

The first time instant t1 of the first point HS is representative of an instant of interaction of a portion of a foot of the user U with the physical exercise surface 104, at the beginning of the interaction of the foot of the user U with the physical exercise surface 104.

In an embodiment, either alternatively to or in combination with the preceding ones, the step of (b) determining 502 further comprises a step of (e) determining 505, by the data processing unit 106, of a second time instant t2 of a second point MS of the periodic trend of the magnitude GR variable over time.

The second point MS has a second value GR2 in the second time instant t2.

The second time instant t2 of the second point MS is representative of the instant of interaction of the same foot of the user U with the physical exercise surface 104, in which the vertical passing through the center of gravity of the body of the user U intersects a contact portion of the foot with the physical exercise surface 104.

It is worth noting that the first point HS and the second point MS of the periodic trend of the magnitude GR variable over time was defined above with reference to FIGS. 5 and 6.

In an embodiment, in combination with the preceding ones, the step of (c) determining 503 further comprises a step of (f) calculating 506, by the data processing unit 106, a time difference ΔT between the second time instant t2 of the second point MS and the first time instant t1 of the first point HS.

The step of (c) determining 503 further comprises a step of (g) providing 507, by the data processing unit 106, an indication of a phase of overstride tsv while the user U runs on the treadmill (100) as a function of the determined time difference Δt.

It is worth noting that the phase of overstride tsv, compared with a reference time difference, is an indication of a parameter representative of the quality of the pace of the user U on the physical exercise surface 104.

Indeed, the closer to zero is the determined time difference ΔT, the more acceptable is the phase of overstride tsv, and vice versa.

In an embodiment (not shown in the figures), either alternatively to or in combination with the preceding ones, the step of (b) determining 502 further comprises a step of determining, by the data processing unit, a third time instant t3 of a third point TO of the periodic trend of the magnitude GR variable over time.

The third point TO has a third value GR3 in third time instant t3.

The third time instant t3 of the third point TO is representative of the instant of interaction of a portion of a foot of the user U on the physical exercise surface 104, before the foot is off the physical exercise surface 104 (beginning of phase of flight of the foot).

In an embodiment (not shown in the figures), in combination with the preceding one, the step of (c) determining 503 comprises a step of determining, by the data processing unit 106, a phase of contact tc of a foot with a physical exercise surface 104 of the treadmill 100.

The phase of contact tc of the foot, from the periodic trend over time of the variable magnitude GR, is determined as a further time difference between the third time instant t3 of the third point TO representative of the instant of interaction of a portion of the foot of the user U on the physical exercise surface 104 before the foot is off the physical exercise surface 104 (beginning of the phase of flight of the foot) and the first time instant t1 of the first point HS representative of the instant of interaction of a portion of the foot of the user U with the physical exercise surface 104 at the beginning of the interaction of the foot of the user U with the physical exercise surface 104 (beginning of the phase of overstride).

Furthermore, in an embodiment, in combination with the preceding one, the step of (c) determining 503 comprises a step of providing, by the data processing unit 106, the phase of overstride tsv as dimensionless ratio (possibly as a percentage) between the time difference Δt representative of the phase of overstride tsv and the further time difference representative of the phase of contact tc of the foot.

In an embodiment, not shown in the figures, either alternatively to or in combination with the preceding ones, the step of (c) determining 503 comprises a step of determining, by the data processing unit 106, a phase of propulsion tp of a foot with a physical exercise surface 104 of the treadmill 100.

The phase of propulsion tp of the foot, from the periodic trend over time of variable magnitude GR, is determined as a further time difference between the third time instant t3 of the third point (T01 in FIG. 7) representative of the instant of interaction of a portion of the foot of the user U on the physical exercise surface 104, before the foot is off the physical exercise surface 104 (beginning of phase of flight of the foot) and the second time instant t2 of the second point MS representative of the instant of interaction of the foot of the user U with the physical exercise surface 104 in which the vertical line passing through the center of gravity of the body of the user U intersects a contact portion of the foot with the physical exercise surface 104 (beginning of the phase of propulsion tp).

In a further embodiment, not shown in the figures, in combination with the preceding ones, the step of (b) determining 502 comprises a step of determining, by the data processing unit 106, a further time instant t6 of a further third point TO of the periodic trend of the magnitude GR variable over time. The further third point TO has a respective third value GR3.

The further time instant t6 of the further third point TO is representative of the instant of interaction of a portion of a foot of the user U on the physical exercise surface 104, before the preceding foot is off the physical exercise surface 104 (beginning of phase of flight of the foot).

Indeed, the further time instant t6 is such that the first time instant t1 of the first point HS is comprised between the further time instant t6 and the second time instant t2.

The first value GR1 of first point HS is comprised between the third value GR3 of the third point TO and the second value GR2 of the second point MS.

It is also worth noting that the further third point TO of the periodic trend of magnitude GR variable over time is entirely similar to the third point TO, even if referred to the other foot, defined above, with reference to FIGS. 5 and 6.

In this embodiment, the step of (c) determining 503 further comprises a step of calculating, by the data processing unit 106, a further time difference between the further third time instant t6 of the further third point TO and the first time instant t1 of the first point HS. The further third point TO and the first point HS are related to different feet.

In this embodiment, the step of (c) determining 503 further comprises a step of providing, by the data processing unit 106, an indication of a phase of flight tv1 between different feet while the user U runs as a function of the further determined time difference.

In a further embodiment, either alternatively to or in combination with the preceding ones, the step of determining 503 further comprises a step of calculating, by the data processing unit 106, a further time difference between the third time instant t3 of the third point TO and the first time instant t1 of the first point HS.

The third point TO and the first point HS are related to the same foot but belong to two successive periods relating to the same foot in the trend over time of the magnitude GR variable over time (in FIG. 7).

In this embodiment, the step of (c) determining 503 further comprises a step of providing, by the data processing unit 106, an indication of a phase of flight tv2 of the same foot while the user U runs as a function of the further determined time difference.

According to a further embodiment, in combination with any one of those described above, the magnitude GR variable over time correlated to the interaction of the user U with the physical exercise surface 104 while performing the physical activity is a first absorption electric current I1 of the electric motor 105.

In this embodiment, the step of (a) determining 501 comprises a step of detecting, by the data processing unit 106, the first absorption electric current I1 of the electric motor 105 (not shown in the figures).

In greater detail, as mentioned above, the first absorption electric current I1 can be detected directly by the data processing unit 106 or by using a detection unit operatively associated with the processing unit 106, described above in accordance with various embodiments.

Figure 9:
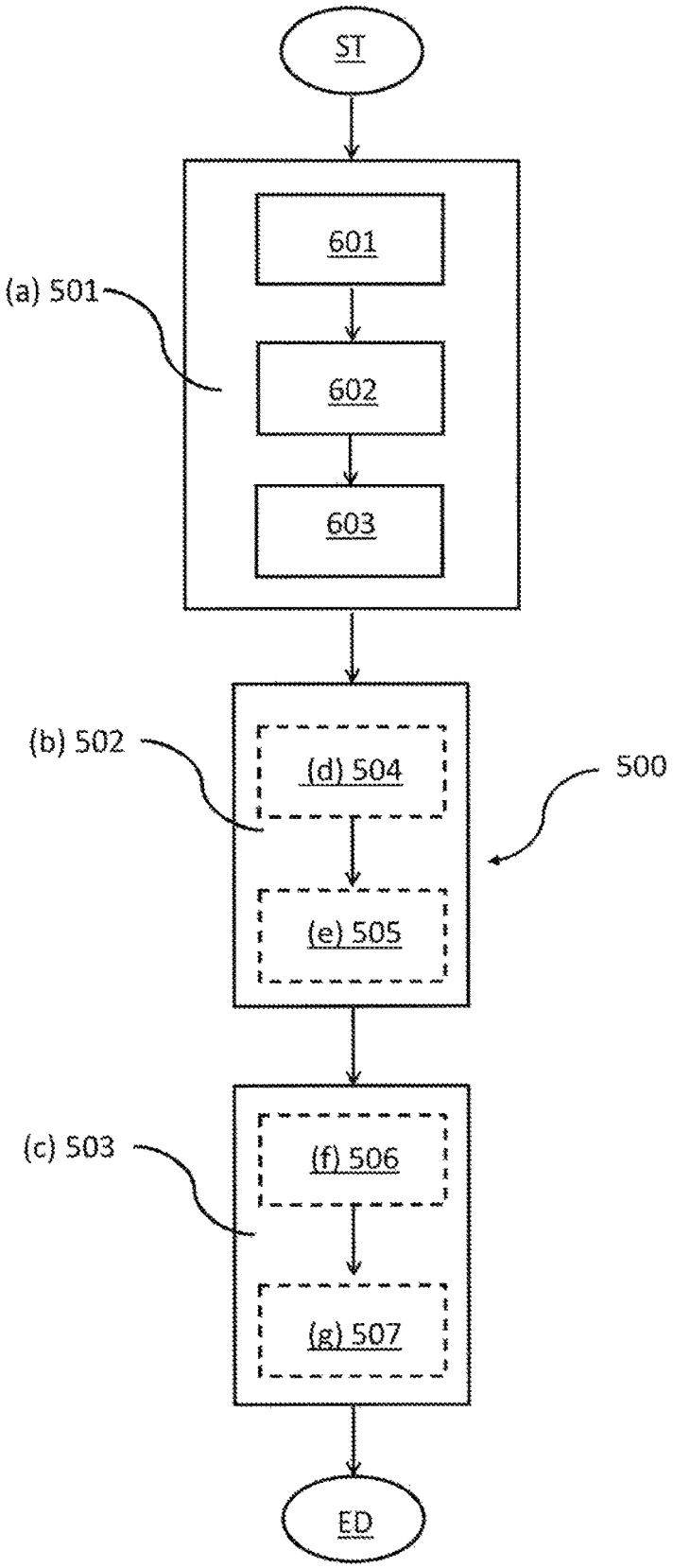
Figure 10:
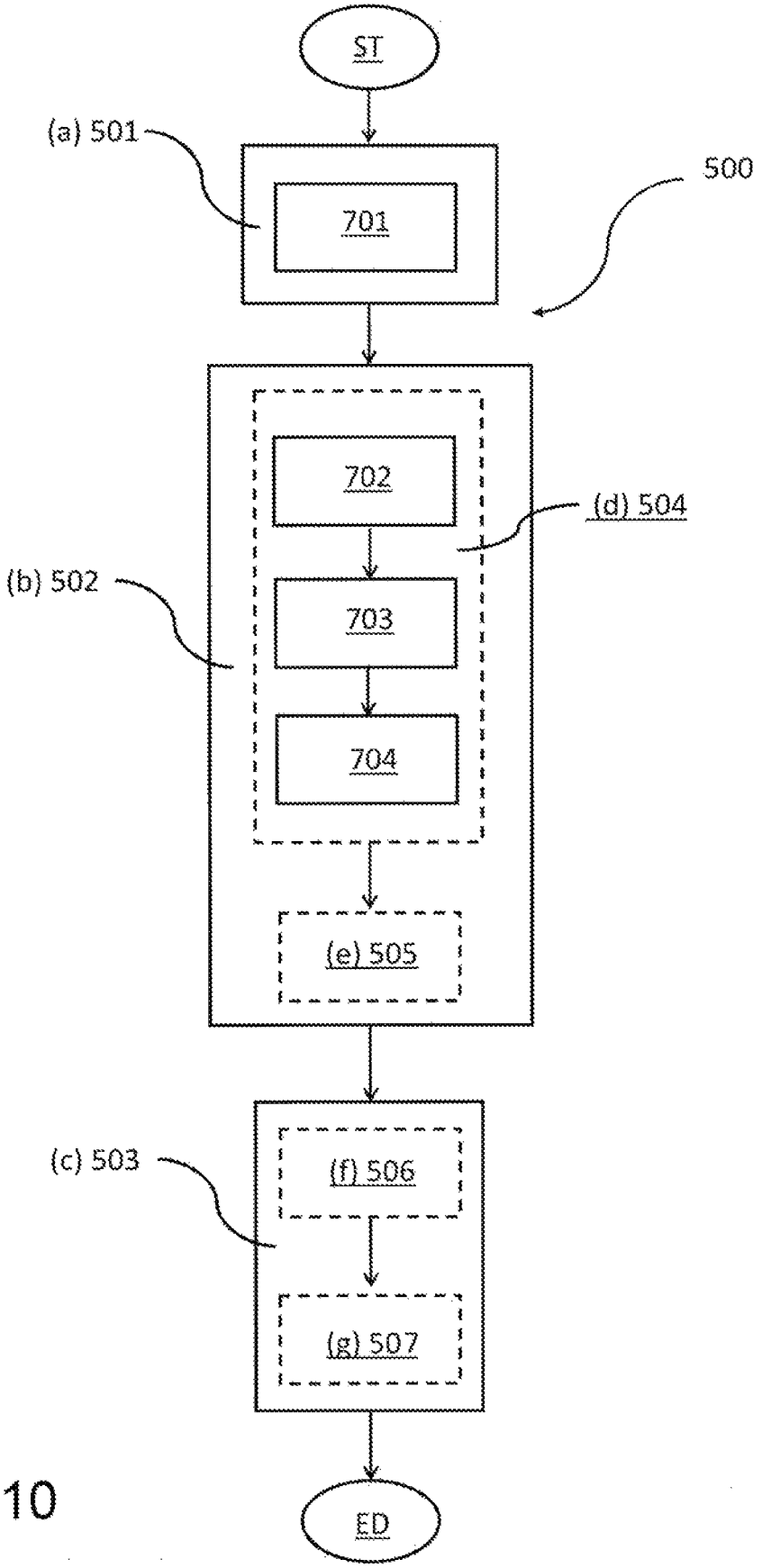

With reference to the embodiment in FIG. 9, in combination with the preceding one, the magnitude GR variable over time correlated to the interaction of the user U with the physical exercise surface 104 while performing the physical activity is a first absorption electric current I1 of the electric motor 105.

In this embodiment, the electric motor 105 is a three-phase motor supplied by a triad of supply currents.

Furthermore, the treadmill 100 comprises at least one speed sensor 114 operatively connected to the electric motor 105 and to the data processing unit 106.

In this embodiment, alternative to the one just described but in combination with any of the other preceding ones, the step of determining 501 the magnitude GR variable over time correlated to the interaction of the user U with the physical exercise surface 104 while performing the physical activity comprises steps of:

detecting 601, by the data processing unit 106, the triad of power supply electric currents of the electric motor 105 of the three-phase type;

detecting 602, by the at least one speed sensor 114, the instantaneous rotational speed VR of the electric motor 105;

determining 603, by the data processing unit 106, the first absorption electric current I1 of the electric motor 105 as a function of the triad of power supply electric currents of the electric motor 105 of the three-phase type and of the trend over time of the speed detected by the at least one speed sensor 114.

In both the embodiments just described (FIG. 8 and FIG. 9), in which the magnitude GR variable over time correlated to the interaction of the user U with the physical exercise surface 104 while performing the physical activity is the first absorption electric current I1 of the electric motor 105, the step of (e) determining 505 the second time instant t2 of the second point MS of the periodic trend of magnitude GR variable over time comprises a step of calculating the second time instant t2 of the second point MS having a second value IV2 as maximum value.

This is performed, for example, by comparing successive samples, stored instant by instant, of the periodic trend of the first absorption electric current I1 of the electric motor 105, once the step corresponding to one of a foot or the other foot (e.g. by selecting one foot at each even climb front and the other foot at each odd climb front).

In particular, the maximum value corresponding to the second point MS is determined by evaluating a current sample of the first absorption electric current I1 of the electric motor 105 with respect to a last stored maximum value of first absorption electric current I1 of the electric motor 105.

In this embodiment, the step of (d) determining 504, by the data processing unit 106, the first time instant t1 of the first point HS of the periodic trend of the first absorption electric current I1 of the electric motor 105 comprises a step of determining a first value IV1 of the first point HS at the first time instant t1.

In an embodiment, the first value IV1 is determined as the minimum value of the derivative of the periodic trend over time of the first absorption electric current I1 of the electric motor 105, prior to the second point MS.

The first time instant t1 is determined by the periodic trend over time of the first absorption electric current I1 of the electric motor 105, at the first value IV1.

In the embodiment just described, in which the magnitude GR variable over time correlated to the interaction of the user U with the physical exercise surface 104 while performing the physical activity is the first absorption electric current I1 of the electric motor 105, the step of determining the third time instant t3 the third point TO of the periodic trend of magnitude GR variable over time comprises a step of calculating the third point TO having a third value IV3 in the third time instant t3 as minimum value.

Once again, the minimum value corresponding to the third point TO is determined by evaluating a current sample of the first absorption electric current I1 of the electric motor 105 with respect to a last stored minimum value of first absorption electric current I1 of the electric motor 105.

In accordance with an embodiment, in combination with any one of those described above but as an alternative to those in which the magnitude GR variable over time correlated to the interaction of the user U with the physical exercise surface 104 while performing the physical activity is the first absorption electric current I1 of the electric motor 105, the magnitude GR variable over time correlated to the interaction of the user U with the physical exercise surface 104 while performing the physical activity is the instantaneous rotation speed VR of the electric motor 105.

In this embodiment, the treadmill 100 comprises at least one speed sensor 114 operatively connected to the electric motor 105 and to the data processing unit 106.

According to an embodiment, in combination with the preceding one, the step of determining 501 the magnitude GR variable over time correlated to the interaction of the user U with the physical exercise surface 104 while performing the physical activity comprises a step of detecting 701, by at least one speed sensor 114, the instantaneous rotational speed VR of the electric motor 105.

In this embodiment, the step of (d) determining 504 the first time instant t1 of the first point HS of the periodic trend of the instantaneous rotational speed VR of the electric motor 105 comprises steps of:

comparing 702, by the data processing unit 106, the instantaneous rotational speed VR of the electric motor 105 detected with a reference value VG of the instantaneous rotational speed by determining an instantaneous deviation between the time trend of the instantaneous rotational speed VR of the electric motor 105 detected and the reference value VG of the instantaneous rotational speed;

comparing 703, by the data processing unit 106, the instantaneous deviation determined with a set reference deviation value Δst;

selecting 704, as the first time instant t1 of the first point HS, the time instant in which the instantaneous deviation is greater than or equal to the set reference deviation value Δst.

So, with respect to the embodiments in which the magnitude GR variable over time correlated to the interaction of the user U with the physical exercise surface 104 while performing the physical activity is the first absorption electric current I1 of the electric motor 105, determining the first time instant t1 of the first value HS if the magnitude GR variable over time correlated to the interaction of the user U with the physical exercise surface 104 while performing the physical activity is the instantaneous rotation speed VR of the electric motor 105, is simpler and more reliable.

Furthermore, in this embodiment, the step of (e) determining 505 the second time instant t2 of the second point MS of the periodic trend of the magnitude GR variable over time comprises a step of calculating the second point MS having a second value VR2 in the second time instant (t2) as minimum value.

This is performed, for example, by comparing successive samples, stored instant by instant, of the periodic trend of the instantaneous rotation speed VR of the electric motor 105, once the step corresponding to one of a foot or the other foot (e.g. by selecting one foot at each even climb front and the other foot at each odd climb front).

In particular, the minimum value corresponding to the second point MS is determined by evaluating a current sample of the instantaneous rotation speed VR of the electric motor 105 with respect to a last stored minimum instantaneous rotation speed value VR of the electric motor 105.

In the embodiment just described, in which the magnitude GR variable over time correlated to the interaction of the user U with the physical exercise surface 104 while performing the physical activity is the instantaneous rotation speed VR of the electric motor 105, the step of determining, by the data processing unit 106, the third time instant t3 of the third point TO of the periodic trend of magnitude GR variable over time comprises a step of calculating the third point TO having a third value VR3 in the third time instant t3 as maximum value.

In this case, the maximum value, corresponding to the third point TO, is determined by evaluating at successive instants a current sample of the instantaneous rotation speed VR of the electric motor 105 with respect to a last stored maximum value of the instantaneous rotation speed VR of the electric motor 105.

In accordance with a further embodiment (not shown in the figures), either in combination with or as an alternative to any of those described previously, the method 500 comprises a step of detecting, by at least one distance sensor 113 (e.g. an infrared sensor) with which the treadmill 100 is fitted, operatively connected to the data processing unit 106, a position variation of a portion (e.g. about the knee) of a set leg of the user U (right or left) while performing the physical activity on the treadmill 100, with respect to a reference position (represented by the at least one distance sensor 113).

The method further comprises a step of associating, by the data processing unit 106, a respective piece of information representative of which foot the running phase refers to with each running phase of the user U on the physical exercise surface 104 of the treadmill 100 determined based on said at least two points determined from the plurality of points HS, MS, TO of the periodic trend of the magnitude GR variable over time.

In this embodiment, the method 500 further comprising a step of providing, by the data processing unit 106, an indication of the presence or not of asymmetries during the running phases of the user U on the physical exercise surface 104 of the treadmill 100, based on the running phases of the user U on the physical exercise surface 104 of the treadmill 100 determined with the associated respective piece of information representative of which foot of the leg the running phase refers to.

Indeed, by way of example, indication of asymmetries in the running phases can be provided by evaluating the phase of overstride of the right leg with respect to overstride of the left leg, the phase of contact of the right foot with respect to the phase of contact of the left foot, and so on.

It is worth noting that the detectable asymmetries are indicative of the running quality of the user U on the physical exercise surface 104 of the treadmill 100.

With general reference to FIG. 1, it is worth reasserting that, in an embodiment, the data processing unit 106 comprises a first data processing block 108 operatively connected to the electric motor 105, the data processing unit 106 also comprising a second data processing block 110, the second data processing block 110 being remote with respect to the first data processing block 108.

In accordance with one embodiment, the steps a)-c) of the method 500 are performed by the first data processing block 108 of the data processing unit 106.

In accordance with a further embodiment, alternative to the preceding one, the step (a) of the method 500 is performed by the first data processing block 108 of the data processing unit 106, steps b)-c) of the method 500 instead being performed by the second data processing block 110 of the data processing unit 106 on the basis of the processed data received from the first data processing block 108 of the data processing unit 106.

As apparent, the object of the invention is fully achieved because the method according to the present invention allows to determine running phases of a user on a treadmill without the user needing to be equipped with electronic devices, sensors or other equivalent devices, which could hinder the user's workout on the treadmill.

It is also possible to provide an indication representative of running phases to the user, such as a phase of flight between different feet, a phase of overstride, a phase of propulsion, a phase of contact of the same foot, a phase of flight of the same foot.

Again, instantaneous feedback can be provided to the user with the possibility of promptly correcting running quality, e.g. by receiving tips on how to modify and improve the pace (e.g. by increasing it).

Again, a plurality of parameters designed to identify more and more the user's pace while running and the running quality can be detected from the periodic trend of magnitude GR variable in time.

Furthermore, the detection of a magnitude variable over time correlated to the interaction of the user U with the physical exercise surface 104 while performing the physical activity and the determination, starting therefrom, of characteristic points (first point HS—heel strike—of a first foot; second point MS—mid stance—of the first foot; third point TO—toe off a second foot, adapted to come into contact with the physical exercise surface before the first foot) allow to obtain the indication on the previously defined running phases.

In addition, the particular embodiment in which the magnitude variable over time correlated to the interaction of the user U with the physical exercise surface 104 is the instantaneous rotation speed of the electric motor allows to considerably increase the reliability and accuracy of the indication provided.

Those skilled in art may make changes and adaptations to the method and respective treadmill described above or can replace elements with others which are functionally equivalent in order to meet contingent needs without departing from the scope of the appended claims. All the features described above as belonging to one possible embodiment may be implemented irrespective of the other embodiments described.

The invention claimed is:

1. A method for determining running phases of a user on a treadmill, the treadmill comprising:

a base extending along a longitudinal axis, said base comprising:

a first rotating element and a second rotating element adapted to rotate around respective rotational axes transverse to the longitudinal axis of the base;

a physical exercise surface operatively connected to the first rotating element and to the second rotating element;

an electric motor operatively associated with at least one of said first rotating element and said second rotating element, the electric motor being configured to make the first rotating element and the second rotating element rotate, and to drive the physical exercise surface into rotation;

a data processing unit operatively connected to the electric motor, the data processing unit being configured to control said electric motor;

the method comprising steps of:

(a) determining, by the data processing unit, a magnitude variable over time correlated to interaction of the user with the physical exercise surface while performing physical activity, the magnitude variable over time having a substantially periodic trend;

(b) determining, by the data processing unit, respective time instants of at least two points among a plurality of points of the periodic trend of the magnitude variable over time, the respective time instants of each point of said plurality of points being representative of instants of the interaction of the user with the physical exercise surface of the treadmill while running;

(c) determining, by the data processing unit, at least one running phase of the user on the physical exercise surface of the treadmill as a function of the respective time instants of said at least two points determined from the plurality of points of the periodic trend of the magnitude variable over time wherein the magnitude variable over time correlated to the interaction of the user with the physical exercise surface while performing the physical activity is instantaneous rotational speed of the electric motor.

2. The method according to claim 1, wherein the step of (b) determining comprises a step of (d) determining, by the data processing unit, a first time instant of a first point of the periodic trend of the magnitude variable over time, the first time instant of the first point being representative of an instant of interaction of a portion of a foot of the user on the physical exercise surface, at the beginning of interaction of the foot with the physical exercise surface.

3. The method according to claim 2, wherein the step of (b) determining also comprises a step of (e) determining, by the data processing unit, a second time instant of a second point of the periodic trend of the magnitude variable over time, the second time instant of the second point being representative of an instant of interaction of the foot of the user with the physical exercise surface in which a vertical axis passing through a center of gravity of the body of the user intersects a portion of contact between the foot and the physical exercise surface.

4. The method according to claim 3, wherein the step of (c) determining comprises steps of:

calculating, by the data processing unit, a time difference between the second time instant of the second point and the first time instant of the first point;

(g) providing, by the data processing unit, an indication of a phase of overstride during a run of the user on the treadmill as a function of the time difference determined.

5. The method according to claim 1, wherein the step of (b) determining further comprises a step of determining, by the data processing unit, a third time instant of a third point of the periodic trend of the magnitude variable over time, the third time instant of the third point being representative of the instant of interaction of a portion of the foot of the user on the physical exercise surface before the foot is off the physical exercise surface.

6. The method according to claim 5, the step of (c) determining comprises a step of determining, by the data processing unit, a phase of contact of one foot with the physical exercise surface of the treadmill, the phase of contact of the foot, from the periodic trend over time of the variable magnitude, is determined as a further time difference between the third time instant of the third point representative of the instant of interaction of a portion of the foot of the user on the physical exercise surface before the foot is off the physical exercise surface and the first time instant of the first point representative of the instant of interaction of a portion of the foot of the user with the physical exercise surface at the beginning of the interaction of the foot of the user with the physical exercise surface.

7. The method according to claim 6, wherein the step of (c) determining comprises a step of providing, by the data processing unit, a phase of overstride as a dimensionless ratio between the time difference representative of the phase of overstride and the further time difference representative of the phase of contact of the foot.

8. The method according to claim 5, wherein the step of (c) determining comprises a step of determining, by the data processing unit, a phase of propulsion of a foot with the physical exercise surface of the treadmill, the phase of propulsion of the foot, from the periodic trend over time of the variable magnitude, is determined as a further time difference between the third time instant of the third point representative of the instant of interaction of a foot portion of the user on the physical exercise surface before the foot is off the physical exercise surface and the second time instant of the second point representative of the instant of interaction of the foot of the user with the physical exercise surface where the vertical axis passing through the center of gravity of the body of the user intersects a portion of contact between the foot and the physical exercise surface.

9. The method according to claim 5, wherein the step of (b) determining further comprises a step of determining, by the data processing unit, a further time instant of a further third point of the periodic trend of the magnitude variable over time, the further time instant of the further third point being representative of an instant of interaction of a portion of a previous foot of the user with the physical exercise surface, before the previous foot is off the physical exercise surface.

10. The method according to claim 9, wherein the step of (c) determining comprises steps of:

calculating, by the data processing unit, a further time difference between the further third time instant of the further third point and the first time instant of the first point, the further third point and the first point being related to different feet;

providing, by the data processing unit, an indication of a phase of flight between different feet during the run of the user as a function of the further time difference determined.

11. The method according to claim 5, wherein the step of (c) determining comprises steps of:

calculating, by the data processing unit, a further time difference between the third time instant of the third point and the first time instant of the first point, the third point and the first point being related to the same foot, but belonging to two successive periods relating to the foot of the trend over time of the magnitude variable over time;

providing, by the data processing unit, an indication of a phase of flight of the foot during a run of the user as a function of the further time difference determined.

12. The method according to claim 1, wherein the treadmill comprises at least one speed sensor operatively connected to the electric motor and to the data processing unit, the step of (a) determining the magnitude variable over time related to the interaction of the user with the physical exercise surface while performing the physical activity comprising a step of detecting, by at least one speed sensor, the instantaneous rotational speed of the electric motor.

13. The method according to claim 1, wherein the step of (d) determining the first time instant of the first point of the periodic trend of the instantaneous rotational speed of the electric motor comprises steps of:

comparing, by the data processing unit, the instantaneous rotational speed of the electric motor detected with a reference value of the instantaneous rotational speed by determining an instantaneous deviation between the trend over time of the instantaneous rotational speed of the electric motor detected and the reference value of the instantaneous rotational speed;

comparing, by the data processing unit, the instantaneous deviation determined by a set reference deviation value;

selecting, as the first time instant of the first point, the time instant in which the instantaneous deviation is greater than or equal to the set reference deviation value.

14. The method according to claim 13, wherein the step of (e) determining the second time instant of the second point of the periodic trend of the magnitude variable over time comprises a step of calculating the second point having a second value in the second time instant as the minimum value.

15. The method according to claim 1, wherein the step of determining, by the data processing unit, the third time instant of the third point of the periodic trend of the magnitude variable over time comprises a step of calculating the third point having a third value in the third time instant as the maximum value.

16. A method for determining running phases of a user on a treadmill, the treadmill comprising:

a base extending along a longitudinal axis, said base comprising:

a first rotating element and a second rotating element adapted to rotate around respective rotational axes transverse to the longitudinal axis of the base;

a physical exercise surface operatively connected to the first rotating element and to the second rotating element;

an electric motor operatively associated with at least one of said first rotating element and said second rotating element, the electric motor being configured to make the first rotating element and the second rotating element rotate, and to drive the physical exercise surface into rotation;

a data processing unit operatively connected to the electric motor, the data processing unit being configured to control said electric motor;

the method comprising steps of:

(a) determining, by the data processing unit, a magnitude variable over time correlated to interaction of the user with the physical exercise surface while performing physical activity, the magnitude variable over time having a substantially periodic trend;

(b) determining, by the data processing unit, respective time instants of at least two points among a plurality of points of the periodic trend of the magnitude variable over time, the respective time instants of each point of said plurality of points being representative of instants of the interaction of the user with the physical exercise surface of the treadmill while running;

(c) determining, by the data processing unit, at least one running phase of the user on the physical exercise surface of the treadmill as a function of the respective time instants of said at least two points determined from the plurality of points of the periodic trend of the magnitude variable over time; and (d) detecting, by at least one distance sensor with which the treadmill is fitted, operatively connected to the data processing unit, a position variation of a portion of a set leg of the user while performing the physical activity on the treadmill relative to a reference position.

17. The method according to claim 16, further comprising a step of associating, by the data processing unit, each running phase of the user on the physical exercise surface of the treadmill determined based on said respective time instants of at least two points determined from the plurality of points of the periodic trend of the magnitude variable over time, a respective piece of information representative of which foot the running phase refers to.

18. The method according to claim 17, further comprising a step of providing, by the data processing unit, an indication of presence of asymmetries during the running phases of the user on the physical exercise surface of the treadmill, based on the running phases of the user on the physical exercise surface of the treadmill determined with the associated respective piece of information representative of which foot the running phase refers to.

19. A treadmill comprising:

a base extending along a longitudinal axis, said base comprising:

a first rotating element and a second rotating element adapted to rotate around respective rotational axes transverse to the longitudinal axis of the base;

a physical exercise surface operatively connected to the first rotating element and to the second rotating element;

an electric motor operatively associated with at least one of said first rotating element and second rotating element, the electric motor being configured to make the first rotating element and the second rotating element rotate, and to drive the physical exercise surface into rotation;

a data processing unit operatively connected to the electric motor, the data processing unit being configured to control said electric motor, the data processing unit being configured to:

(a) determine a magnitude variable over time correlated to interaction of the user with the physical exercise surface while performing the physical activity, the magnitude variable over time having a substantially periodic trend;

(b) determine respective time instants of at least two points among a plurality of points of the periodic trend of the magnitude variable over time, the respective time instants of each point of said plurality of points being representative of instants of the interaction of the user with the physical exercise surface of the treadmill while running;

(c) determine at least one running phase of the user on the physical exercise surface of the treadmill as a function of the respective time instants of said at least two points determined from the plurality of points of the periodic trend of the magnitude variable over time;

(d) detect, by at least one distance sensor with which the treadmill is fitted, operatively connected to the data processing unit, a position variation of a portion of a set leg of the user while performing the physical activity on the treadmill relative to a reference position.

* * * * *